US010392208B2

(12) United States Patent
Yoshida et al.

(10) Patent No.: US 10,392,208 B2
(45) Date of Patent: Aug. 27, 2019

(54) SHEET FEEDING APPARATUS AND IMAGE FORMING APPARATUS

(71) Applicant: CANON KABUSHIKI KAISHA, Tokyo (JP)

(72) Inventors: Masatoshi Yoshida, Susono (JP); Shunsuke Okazaki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/880,694

(22) Filed: Jan. 26, 2018

(65) Prior Publication Data

US 2018/0222699 A1 Aug. 9, 2018

(30) Foreign Application Priority Data

Feb. 7, 2017 (JP) ..... 2017-020783
Feb. 7, 2017 (JP) ..... 2017-020784

(51) Int. Cl.
*B65H 1/14* (2006.01)
*B65H 1/26* (2006.01)
*B65H 3/06* (2006.01)

(52) U.S. Cl.
CPC ..... *B65H 1/14* (2013.01); *B65H 1/266* (2013.01); *B65H 3/0669* (2013.01); *B65H 3/0684* (2013.01); *B65H 2403/40* (2013.01); *B65H 2403/41* (2013.01); *B65H 2403/72* (2013.01)

(58) Field of Classification Search
CPC ..... B65H 1/14; B65H 1/266; B65H 3/0669; B65H 3/0684; B65H 2403/40; B65H 2403/72; B65H 2403/41
See application file for complete search history.

(56) References Cited

U.S. PATENT DOCUMENTS 5,775,686 A * 7/1998 Miyake ..... B65H 1/266 271/127
7,513,496 B2 * 4/2009 Hattori ..... B65H 1/12 271/117
7,681,877 B2 * 3/2010 Won ..... G03G 15/5004 271/117

(Continued)

FOREIGN PATENT DOCUMENTS

JP 2004-331350 A 11/2004
JP 2009-062158 A 3/2009
JP 2014-114128 A 6/2014

OTHER PUBLICATIONS

Masatoshi Yoshida, U.S. Appl. No. 15/880,718, filed Jan. 26, 2018.

(Continued)

*Primary Examiner* — Patrick Cicchino
(74) *Attorney, Agent, or Firm* — Venable LLP

(57) ABSTRACT

A sheet feeding apparatus includes a sheet support portion to support a sheet, an ascending portion to raise the sheet support portion, a feeding portion to feed the sheet, a moving portion to move the feeding portion between a separated position and a feeding position, a holding portion to move between a holding position and an allowing position, a drive source, and a transmission unit including a first transmission portion to transmit the driving force to the ascending portion and a second transmission portion to transmit the driving force to the holding portion.

24 Claims, 20 Drawing Sheets

(56) References Cited

U.S. PATENT DOCUMENTS

| | | | | |
|---|---|---|---|---|
| 7,971,868 | B2 | 7/2011 | Matsushima et al. | |
| 7,984,902 | B2 * | 7/2011 | Kuroda | B65H 3/0607 271/152 |
| 8,224,229 | B2 * | 7/2012 | Okamoto | G03G 15/6502 399/391 |
| 8,276,906 | B2 * | 10/2012 | Yamamoto | B65H 3/0607 271/127 |
| 8,668,198 | B2 | 3/2014 | Tsuji et al. | |
| 8,800,986 | B2 * | 8/2014 | Tomatsu | G03G 15/757 271/126 |
| 8,905,399 | B2 | 12/2014 | Murashima et al. | |
| 9,771,226 | B2 * | 9/2017 | Zensai | B65H 3/0684 |
| 9,828,197 | B2 * | 11/2017 | Hashimoto | G03G 15/6511 |
| 9,840,382 | B2 | 12/2017 | Okasaki et al. | |
| 2005/0087921 | A1 | 4/2005 | Aoki et al. | |
| 2008/0128973 | A1 * | 6/2008 | Hirose | B65H 3/0684 271/117 |
| 2011/0156342 | A1 * | 6/2011 | Iino | B65H 3/0684 271/10.11 |
| 2015/0344246 | A1 * | 12/2015 | Zensai | B65H 3/0669 271/10.13 |
| 2017/0217698 | A1 | 8/2017 | Yoshida et al. | |
| 2017/0217707 | A1 | 8/2017 | Fujinuma et al. | |
| 2018/0050878 | A1 | 2/2018 | Okazaki et al. | |

OTHER PUBLICATIONS

Shunsuke Okazaki, U.S. Appl. No. 15/884,486, filed Jan. 31, 2018.
European Search Report dated Jul. 3, 2018, in related European Patent Application No. 18152242.6.

* cited by examiner 85
81
81a
82
82c
81c
81b
82b
89
L1
82a
α

85
81
82
82c
81c
G
89
L2
82a 85
81
82
82c
81c
α
89
L1

SHEET FEEDING APPARATUS AND IMAGE FORMING APPARATUS

BACKGROUND OF THE INVENTION

Field of the Invention

The present invention relates to a sheet feeding apparatus configured to feed a sheet and an image forming apparatus including the sheet feeding apparatus.

Description of the Related Art

Generally, an image forming apparatus such as a copier or a printer includes a feeding cassette configured to accommodate sheets to be supplied to an image forming portion and be capable of being attached to and drawn out from an image forming apparatus body. The image forming apparatus body will be hereinafter referred to as an apparatus body. In this image forming apparatus, accompanied by attachment of the feeding cassette, a feeding roller descends to a feeding position for feeding a sheet and comes into contact with a sheet in the feeding cassette. Then, the feeding roller rotates in a sheet feeding direction in accordance with a feeding signal, and thus the sheets accommodated in the feeding cassette are sequentially sent out downstream starting from the topmost sheet. In addition, when the feeding cassette is drawn out, the feeding roller moves upward such that the feeding roller does not come into contact with a sheet in the feeding cassette.

Conventionally, Japanese Patent Laid-Open No. 2009-62158 has proposed a sheet feeding apparatus including a roller holder that supports a feeding roller in an ascendible and descendible manner, a cam member that rotates in accordance with drive of a feeding motor and causes the roller holder to ascend and descend, an inner plate that supports a sheet, and a lift motor that causes the inner plate to ascend and descend. The cam member is controlled to rotate only once by a partially toothed gear and a flapper member that acts due to a solenoid and regulates the rotation of the partially toothed gear. When the feeding roller is positioned at the feeding position in a state in which the feeding roller is in contact with the inner plate, the lift motor is stopped, and thus positioning of the inner plate is completed.

However, the sheet feeding apparatus disclosed in Japanese Patent Laid-Open No. 2009-62158 uses a dedicated solenoid for ascent and descent of the feeding roller in addition to the feeding motor, and this has been a cause for increase of the costs.

SUMMARY OF THE INVENTION

According to a first aspect of the present invention, a sheet feeding apparatus includes a sheet support portion configured to support a sheet, an ascending portion configured to cause the sheet support portion to ascend, a feeding portion configured to feed the sheet supported by the sheet support portion, a moving portion configured to support the feeding portion such that the feeding portion is movable between a separated position and a feeding position below the separated position, the separated position being a position at which the feeding portion is separated from the sheet supported by the sheet support portion, the feeding position being a position at which the feeding portion is capable of feeding the sheet supported by the sheet support portion, a holding portion configured to move between a holding position and an allowing position, the holding position being a position at which the holding portion holds the moving portion in a state in which the feeding portion is positioned at the separated position, the allowing position being a position at which the holding portion allows the feeding portion to move to the feeding position, a drive source configured to generate driving force, and a transmission unit including a first transmission portion and a second transmission portion, the first transmission portion being configured to transmit the driving force from the drive source to the ascending portion, the second transmission portion being configured to transmit the driving force from the drive source to the holding portion. The holding portion moves toward the allowing position in a case where the driving force from the drive source is transmitted to the ascending portion and the holding portion respectively through the first transmission portion and the second transmission portion, and the sheet support portion is caused to ascend by the ascending portion.

According to a second aspect of the present invention, a sheet feeding apparatus includes a sheet support portion configured to support a sheet, an ascending portion configured to cause the sheet support portion to ascend, a feeding portion configured to feed the sheet supported by the sheet support portion, a moving portion configured to support the feeding portion such that the feeding portion is movable between a separated position, a feeding position below the separated position, and a lower position below the feeding position, the separated position being a position at which the feeding portion is separated from the sheet supported by the sheet support portion, the feeding position being a position at which the feeding portion is capable of feeding the sheet supported by the sheet support portion, a detection portion configured to detect the feeding portion positioned at the feeding position, a holding portion configured to move between a holding position and an allowing position, the holding position being a position at which the holding portion holds the moving portion in a state in which the feeding portion is positioned at the separated position, the allowing position being a position at which the holding portion is capable of holding the moving portion in a state in which the feeding portion is positioned at the lower position and allows the feeding portion to move from the lower position to the feeding position, a drive source configured to generate driving force, and a transmission unit configured to transmit the driving force from the drive source to the ascending portion and the holding portion. The transmission unit includes a delay mechanism configured to start driving the ascending portion after start of movement of the holding portion such that, in a case where the drive source is driven, the feeding portion comes into contact with an upper surface of the sheet supported by the sheet support portion in a state in which the feeding portion is positioned between the feeding position and the lower position.

Further features of the present invention will become apparent from the following description of exemplary embodiments with reference to the attached drawings.

DESCRIPTION OF THE EMBODIMENTS

First Exemplary Embodiment

Overall Configuration

Figure 1:
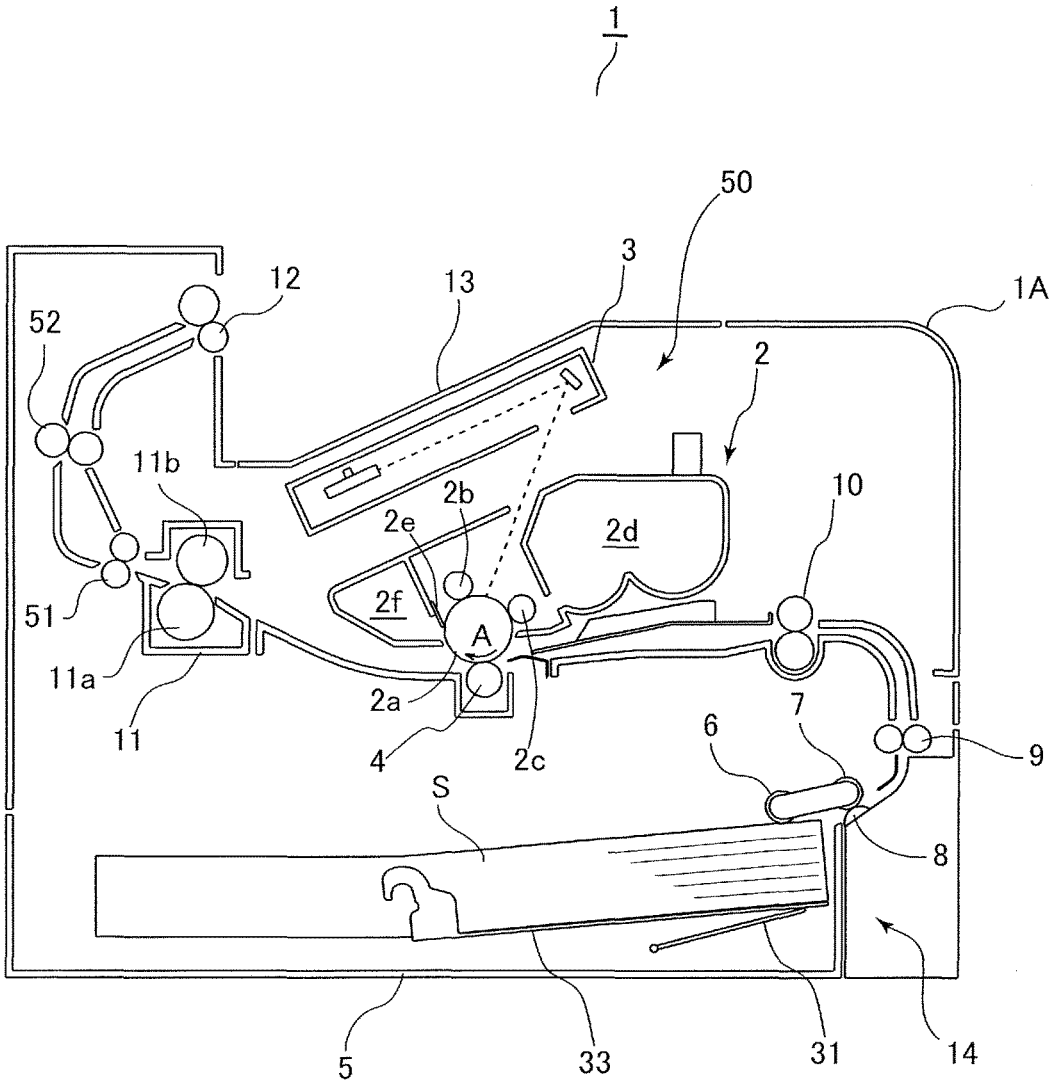
FIG. 1 is an overall schematic diagram illustrating a printer according to a first exemplary embodiment.

First, a first exemplary embodiment of the present invention will be described. A printer 1 serving as an image forming apparatus is a laser beam printer of an electrophotographic system that forms a monochromatic toner image. As illustrated in FIG. 1, the printer 1 includes a sheet feeding apparatus 14 and an image forming portion 50. The sheet feeding apparatus 14 feeds a supported sheet, and the image forming portion 50 forms an image on the fed sheet. In addition, the printer 1 includes a fixing device and a discharge roller pair 12. The fixing device 11 fixes an image transferred onto a sheet, and the discharge roller pair 12 is capable of discharging a sheet onto a discharge tray 13.

When an instruction of image formation is output to the printer 1, the image forming portion 50 starts an image formation process on the basis of image information input from, for example, an external computer connected to the printer 1. The image forming portion 50 includes a process cartridge 2, a laser scanner 3, and a transfer roller 4. The process cartridge 2 includes a photosensitive drum 2*a*, a charging roller 2*b*, a developing roller 2*c*, a cleaning blade 2*e*, a toner container 2*d*, and a waste toner container 2*f*. The photosensitive drum 2*a* rotates in an arrow A direction. The charging roller 2*b*, the developing roller 2*c*, and the cleaning blade 2*e* are disposed along the photosensitive drum 2*a*. The process cartridge 2 is attachable to and detachable from an apparatus body 1A of the printer 1.

The laser scanner 3 irradiates the photosensitive drum 2*a* with a laser beam on the basis of the input image information. At this time, the photosensitive drum 2*a* has been charged in advance by the charging roller 2*b*, and an electrostatic latent image is formed on the photosensitive drum 2*a* as a result of the irradiation of the laser beam. Then, the electrostatic latent image is developed by the developing roller 2*c*, and a monochromatic toner image is formed on the photosensitive drum 2*a*.

In parallel with the image formation process described above, a sheet S is fed from the sheet feeding apparatus 14. The sheet feeding apparatus 14 includes a cassette 5 serving as a drawer portion supported to be capable of being attached to and drawn out from the apparatus body 1A in a direction perpendicular to a feeding direction of the sheet S. The cassette 5 supports an inner plate 33 serving as a sheet support portion that supports the sheet S. The sheet S supported on the inner plate 33 is fed by a pickup roller 6 serving as a feeding portion. In the case where a plurality of sheets S are fed by the pickup roller 6, one sheet S is separated from the sheets S by a feed roller 7 and a separation roller 8 in pressure contact with the feed roller 7.

The separation roller 8 includes a torque limiter therein, and, in the case where one sheet is conveyed to a separation nip formed by the feed roller 7 and the separation roller 8, a limit value of the torque limiter is set such that the separation roller 8 rotates in accordance with the feed roller 7. In addition, when a plurality of sheets are conveyed to the separation nip, the separation roller 8 stops without rotating in accordance with the feed roller 7. To be noted, drive to convey a sheet in a direction opposite to a sheet conveyance direction of the feed roller 7 may be input to the separation roller 8. In addition, although a single-tier cassette 5 is provided in the present exemplary embodiment, a plurality of cassettes capable of supporting sheets of respective different sizes may be provided, and a sheet may be fed in accordance with a selected sheet size from a corresponding one of the plurality of cassettes.

The sheet S separated by the feed roller 7 and the separation roller 8 is conveyed to a registration roller pair 10 by a conveyance roller pair 9, and the skew thereof is corrected by the registration roller pair 10. The sheet S is conveyed to the photosensitive drum 2*a* by the registration roller pair 10 at a predetermined conveyance timing, and the toner image on the photosensitive drum 2*a* is transferred onto the sheet S due to an electrostatic load bias applied to the transfer roller 4. Residual toner remaining on the photosensitive drum 2*a* is collected into the waste toner container 2*f* by the cleaning blade 2*e*.

The sheet S onto which the toner image has been transferred is subjected to predetermined heat and pressure applied by a heating roller 11*a* and a pressurizing roller 11*b* of the fixing device 11, and thus the toner is melted and fixed. The sheet S that has passed through the fixing device 11 is conveyed to the discharge roller pair 12 by conveyance roller pairs 51 and 52, and is discharged onto the discharge tray 13 by the discharge roller pair 12.

Sheet Feeding Apparatus

Figure 2:
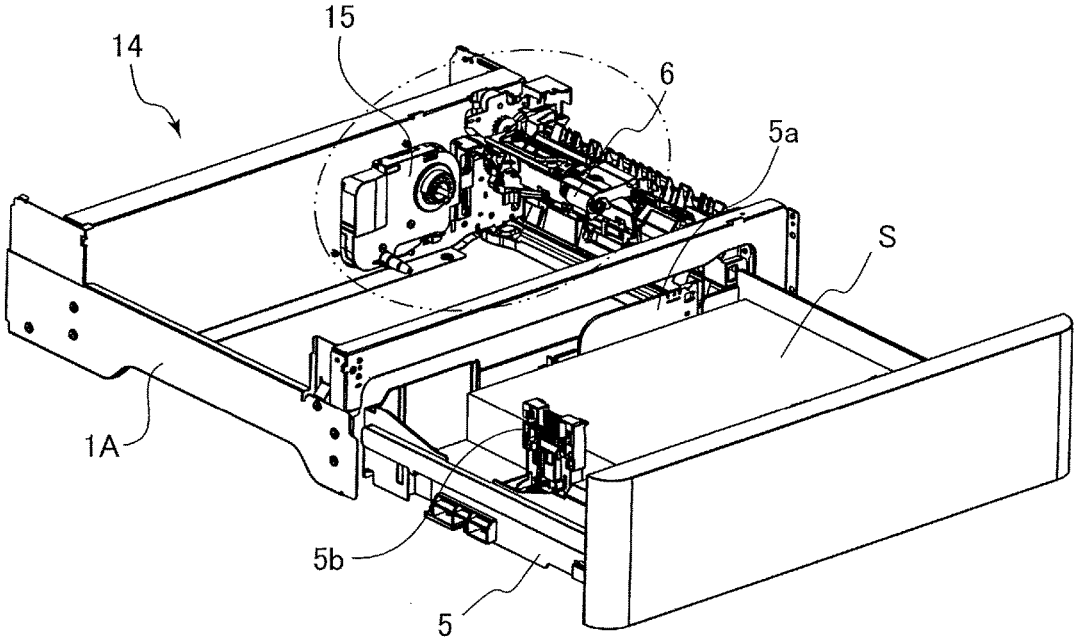
FIG. 2 is a perspective view illustrating a state in which a cassette has been drawn out from an apparatus body.
Figure 3:
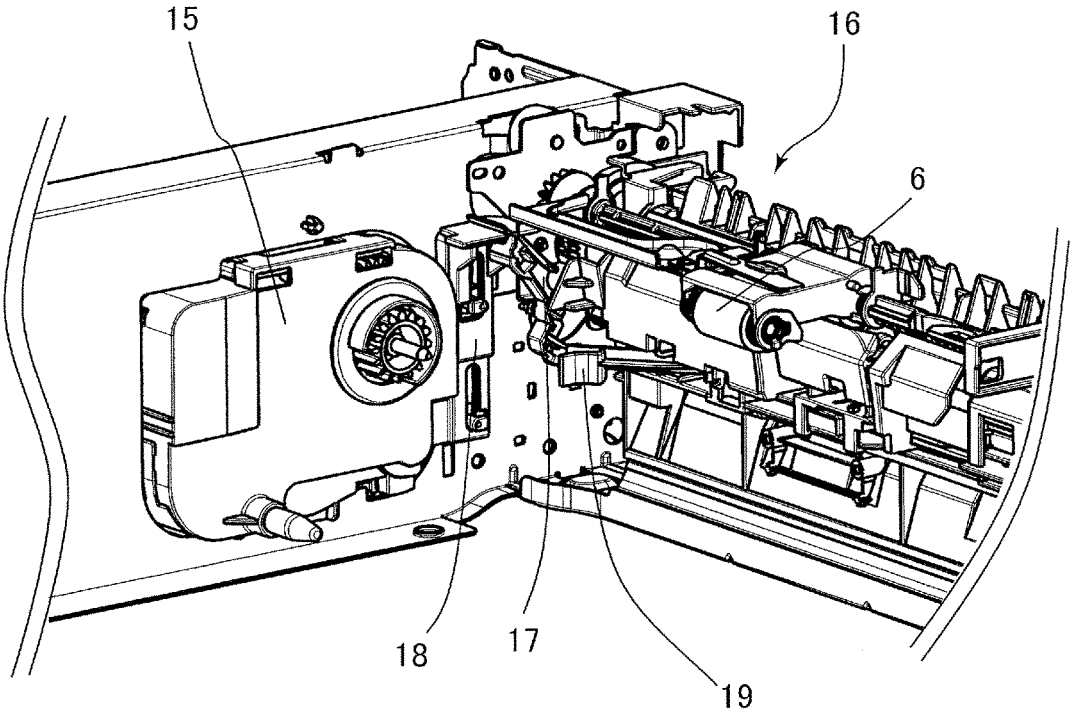
FIG. 3 is an enlarged perspective view of a part circled by a two-dot chain line in FIG. 2.
Figure 4:
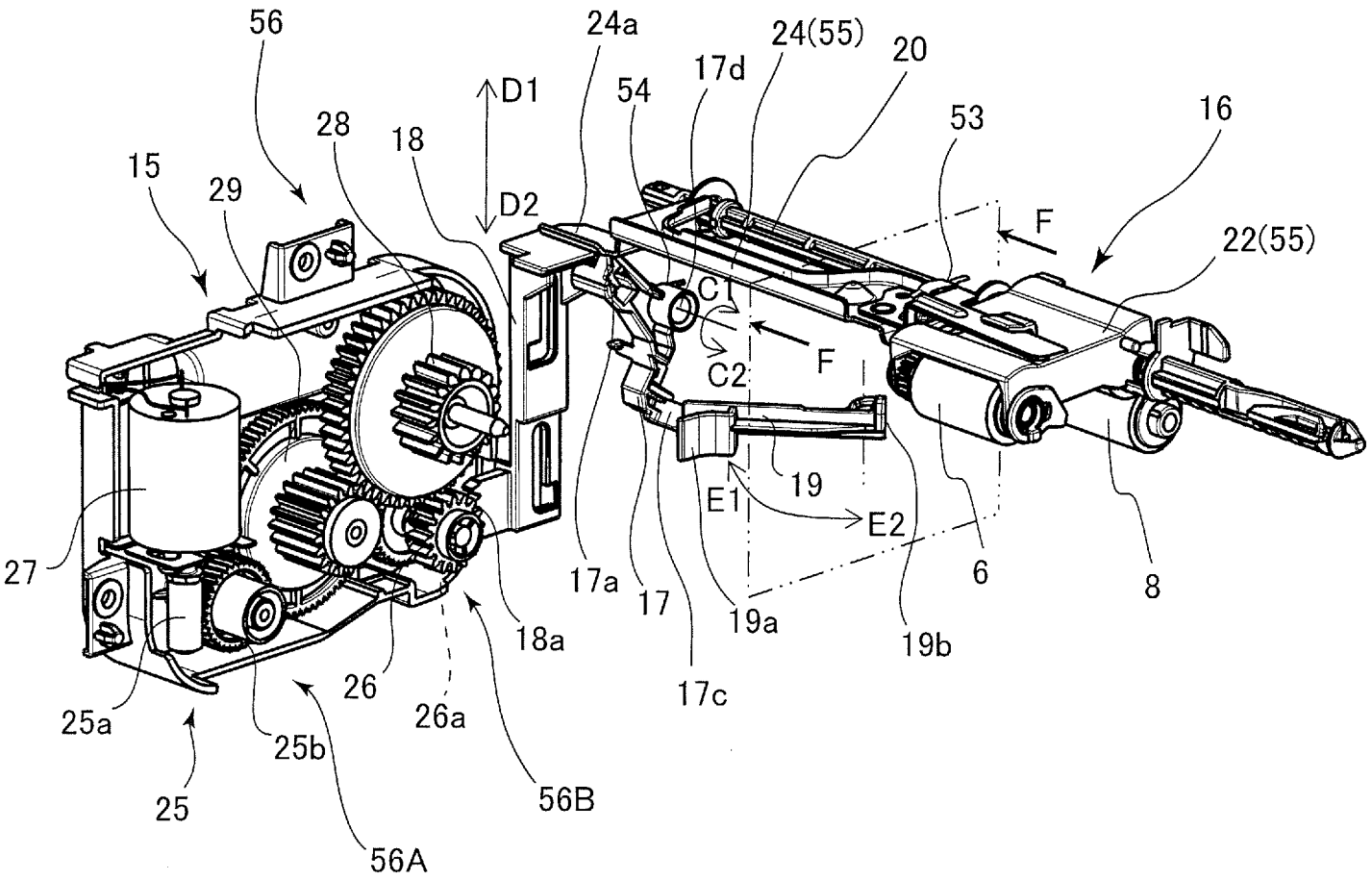
FIG. 4 is a perspective view of a drive unit and a roller unit.

Next, the sheet feeding apparatus 14 will be described. FIG. 2 is a perspective view of the cassette 5 drawn out from the sheet feeding apparatus 14. To be noted, in FIG. 2, illustration is given by omitting some components such as a housing and a frame for the sake of convenience. FIG. 3 is an enlarged perspective view of a part circled by a two-dot chain line in FIG. 2. FIG. 4 is a perspective view of components to be used in description of the present invention that have been extracted from FIG. 3.

As illustrated in FIG. 2, the cassette 5 includes a pair of side regulation plates 5*a* and a trailing end regulation plate 5*b*. The pair of side regulation plates 5*a* regulates the positions of end portions of the sheet S in a width direction, and the trailing end regulation plate 5*b* regulates the position of an upstream end of the sheet S in the sheet conveyance direction. As illustrated in FIG. 3, the apparatus body 1A includes a drive unit 15, a roller unit 16, a lever member 19, a first link member 17, and a second link member 18.

Figure 9:
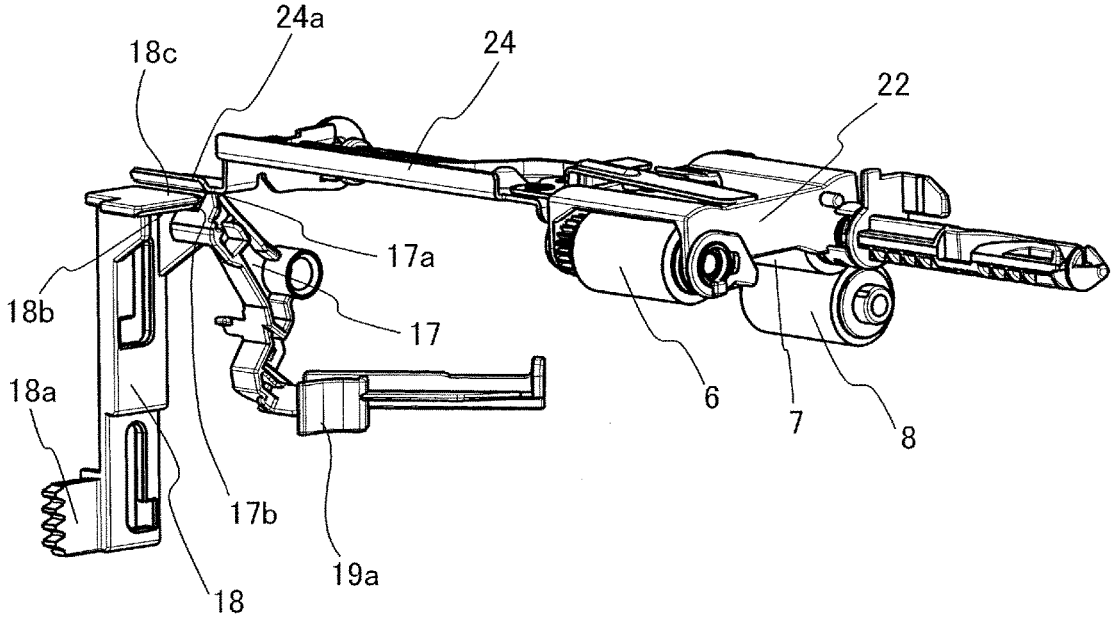
FIG. 9 is a perspective view of the first link member and the second link member in the state in which the cassette has been drawn out.
Figure 12:
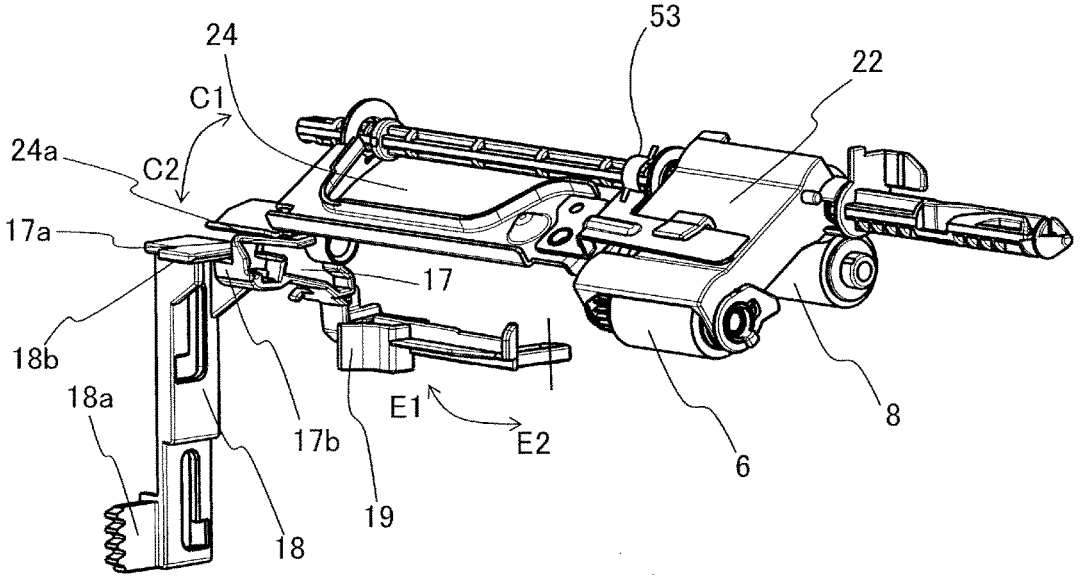
FIG. 12 is a perspective view of the first link member and the second link member in the state in which the cassette has been attached.

As illustrated in FIG. 4, the roller unit 16 includes a drive shaft 20 and a holder 22. The drive shaft 20 is rotatably supported by the apparatus body 1A illustrated in FIG. 2. The holder 22 is relatively rotatably supported with respect to the drive shaft 20, and swingably supports the pickup roller 6. The pickup roller 6 is supported by the holder 22 to be swingable between a separated position, a feeding position, and a lower position. The pickup roller 6 is separated from the sheet S at the separated position. The separated position is illustrated in FIG. 9, and the lower position is illustrated in FIG. 12. The feeding position is below the separated position, and the pickup roller 6 can feed, at the feeding position, the sheet S supported on the inner plate 33. The lower position is below the feeding position.

Figure 5:
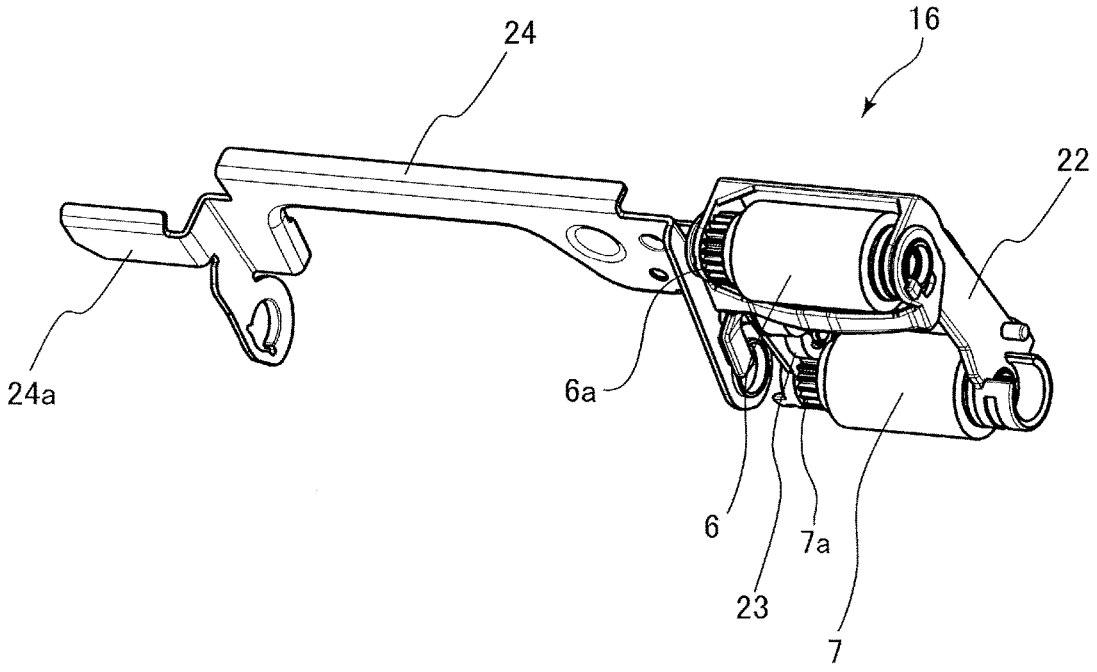
FIG. 5 is a perspective view of a holder and a pushing plate.
Figure 15:
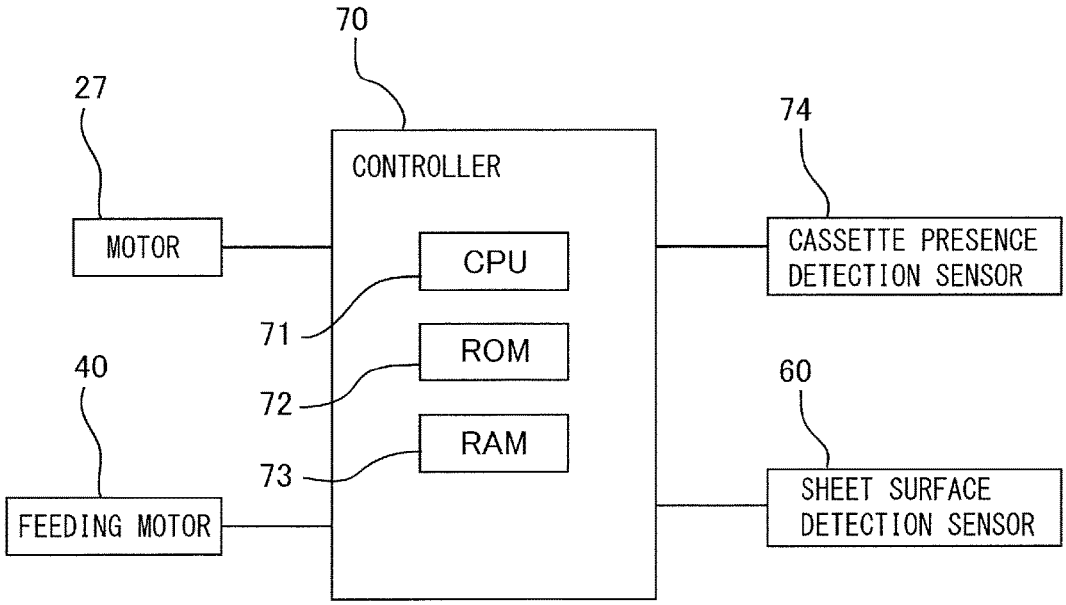
FIG. 15 is a control block diagram according to the first and second exemplary embodiments.

The drive shaft 20 is coupled to a sheet feeding motor 40 illustrated in FIG. 15. As illustrated in FIG. 5, the feed roller 7 is fixed to the drive shaft 20, and a feed gear 7*a* is fixed to one end portion of the feed roller 7. The rotation of the feed gear 7*a* is transmitted to, via a gear train 23, a pickup gear 6*a* fixed to one end portion of the pickup roller 6. Thus, the feed roller 7 and the pickup roller 6 rotate when the drive shaft 20 is rotated by the drive from the sheet feeding motor 40.

As illustrated in FIG. 4, a pushing plate 24 pivotably supported by the drive shaft 20 and extending in the width direction is fastened to the holder 22, and is pressed downward by a torsion coil spring 53 serving as a second urging portion. The torsion coil spring 53 is loosely fit on the drive shaft 20, one end of the torsion coil spring 53 is coupled to the apparatus body 1A illustrated in FIG. 2, and the other end of the torsion coil spring is coupled to the pushing plate 24. The urging force of the torsion coil spring 53 is transmitted to the holder 22 via the pushing plate 24, and thus the holder 22 is urged such that the pickup roller 6 moves downward. To be noted, the holder 22 and the pushing plate 24 constitute a moving portion 55.

The lever member 19 is pivotable about a pivot shaft 19*b* in an E1 direction and an E2 direction, and includes a contact portion 19*a* capable of coming into contact with a downstream end of the cassette 5 in an attaching direction. The pivot shaft 19*b* extends in the vertical direction. The first link member 17 serving as a pressing portion is pivotable about a pivot shaft 17*d* in a C1 direction and a C2 direction, and is urged in the C1 direction by a torsion coil spring 54 serving as an urging portion and a first urging portion. The pivot shaft 17*d* extends parallel to the shaft direction of the drive shaft 20. In addition, the first link member 17 includes a pressed portion 17*c* to be pressed by the contact portion 19*a* of the lever member 19, and the first link member 17 pivots in the C2 direction against the urging force of the torsion coil spring 54 as a result of the pressed portion 17*c* being pressed by the contact portion 19*a*. That is, the first link member 17 is linked with attachment and detachment operations of the cassette 5 in the apparatus body 1A via the lever member 19. Further, the first link member 17 includes a first pressing surface 17*a* and a second pressing surface 17*b* formed on an upper end portion thereof as illustrated in FIG. 9, and the first pressing surface 17*a* is capable of coming into contact with and pressing a side end portion 24*a* of the pushing plate 24. To be noted, the urging force of the torsion coil spring 53 is set to be smaller than the urging force of the torsion coil spring 54.

The second link member 18 serving as a holding portion is supported to be movable in the vertical direction, that is, a D1 direction and a D2 direction illustrated in FIG. 4. As illustrated in FIG. 9, the second link member 18 includes a first contact surface 18*b* and a second contact surface 18*c*. The first contact surface 18*b* is capable of coming into contact with the second pressing surface 17*b* of the first link member 17. The second contact surface 18*c* is formed on the opposite side to the first contact surface 18*b*, and is capable of coming into contact with the side end portion 24*a* of the pushing plate 24. Further, as illustrated in FIG. 4, a rack portion 18*a* is formed on a lower end portion of the second link member 18, and the rack portion 18*a* is engaged with a one-way gear 26 of the drive unit 15. The second link member 18 is movable between a holding position illustrated in FIG. 10 and an allowing position illustrated in FIG. 11. That is, at the holding position, the second link member 18 holds the moving portion 55 such that the pickup roller 6 is positioned at the separated position, and, at the allowing position, the second link member 18 holds the moving portion 55 such that the pickup roller 6 is positioned at the lower position. That is, when the second link member 18 is positioned at the allowing position, the pickup roller 6 is held at the lower position, and is allowed to be moved to the feeding position in this state by being pressed from below by the sheet S on the inner plate 33.

Drive Unit

As illustrated in FIG. 4, the drive unit 15 includes a motor 27, a worm gear pair 25, an intermediate gear 29, a lifter driving gear 28, and the one-way gear 26. The motor 27 generates driving force, the worm gear pair 25 28 serves as a regulation portion, and the lifter driving gear serves as a drive gear. The worm gear pair 25, the intermediate gear 29, the lifter driving gear 28, and the one-way gear 26 constitute a transmission unit 56. In addition, the worm gear pair 25, the intermediate gear 29, and the lifter driving gear 28 constitute a first transmission portion 56A illustrated in FIGS. 4 and 8, and the one-way gear 26 constitutes a second transmission portion 56B branching from the first transmission portion 56A and illustrated in FIGS. 4 and 8. The first transmission portion 56A is capable of transmitting the driving force from the motor 27 to a lift-up plate 31 that will be described later, and the second transmission portion 56B is capable of transmitting the driving force from the motor 27 to the second link member 18. In addition, the second transmission portion 56B is capable of blocking driving force from the second link member 18 to the first transmission portion 56A.

The worm gear pair 25 includes a cylindrical worm 25*a* and a worm wheel 25*b*. The cylindrical worm 25*a* serves as a worm driven by the motor 27, and the worm wheel 25*b* engages with the cylindrical worm 25*a*. With the worm gear pair 25, a large reduction ratio can be set through one step by setting a small lead angle for the worm. That is, when the motor 27 is stopped, the movement of the one-way gear 26 and the rack portion 18*a* of the second link member 18 can be regulated by the large reduction ratio of the worm gear pair 25. To be noted, a spur gear train set to have a large reduction ratio through several steps may be used instead of the worm gear pair 25.

The worm wheel 25*b* is engaged with the intermediate gear 29, and the intermediate gear 29 is engaged with the lifter driving gear 28 and the one-way gear 26. The one-way gear 26 includes a one-way clutch 26*a* therein. The one-way clutch 26*a* transmits the driving force from the motor 27 serving as a drive source to the second link member 18 when the second link member 18 moves from the holding position to the allowing position. In addition, the one-way clutch 26*a* blocks the driving force from the second link member 18 to the motor 27 when the second link member 18 is moved from the allowing position to the holding position by being pressed by the first link member 17.

Figure 6:
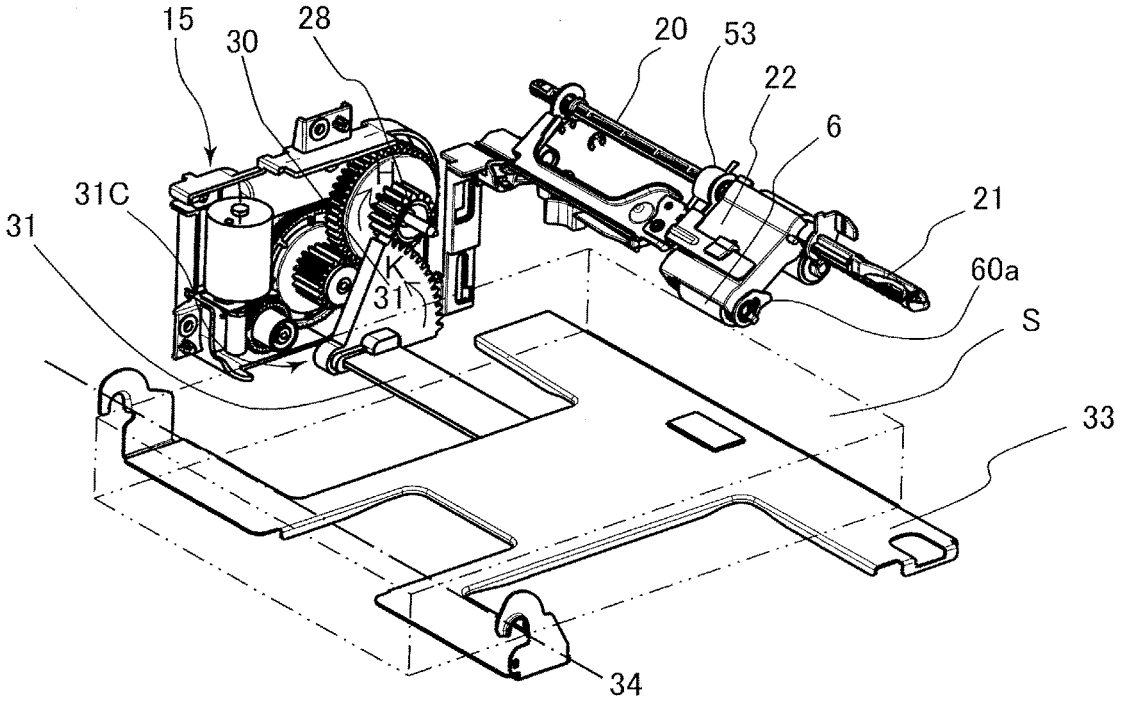
FIG. 6 is a perspective view of a lift-up plate and an inner plate.
Figure 7:
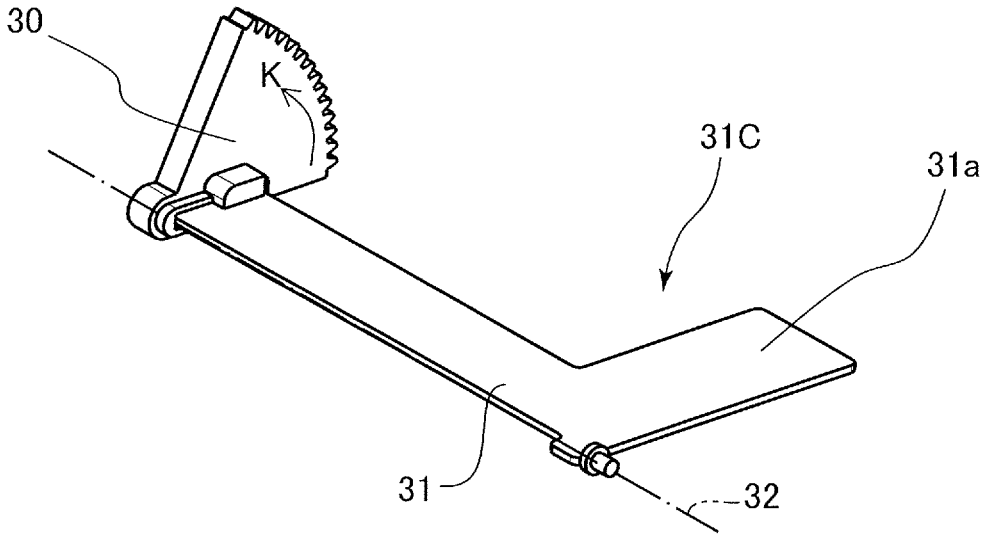
FIG. 7 is a perspective view of a lifter gear and the lift-up plate.

As illustrated in FIG. 6, the lifter driving gear 28 is engaged with a lifter gear 30 serving as a driven gear integrally provided with the lift-up plate 31. The lift-up plate 31 and the lifter gear 30 constitute an ascending portion 31C. As illustrated in FIG. 7, the lift-up plate 31 is pivotable about a pivot shaft 32, and is capable of pushing up the inner plate 33 by a lift portion 31*a*. When the lifter driving gear 28 rotates in an arrow H direction of FIG. 6, the lifter gear 30 rotates in an arrow K direction. Then, the lift-up plate 31 rotates upward about the pivot shaft 32, and the lift portion 31*a* pushes up the inner plate 33 from below. As a result of this, the inner plate 33 pivots upward about a pivot shaft 34.

The holder 22 is provided with a flag member 60*a*, and the apparatus body 1A is provided with a sheet surface detection sensor 60 illustrated in FIG. 15. The sheet surface detection sensor 60 serves as a feeding detection portion that detects the presence or absence of the flag member 60*a*. When the inner plate 33 ascends due to the drive from the motor 27 as described above, the pickup roller 6 in contact with the sheet S on the inner plate 33 is lifted up via the holder 22. Then, when the sheet surface detection sensor 60 detects the flag member 60*a* provided on the holder 22, it is determined that the pickup roller 6 has reached a position suitable for feeding a sheet, that is, the feeding position, and the motor 27 is stopped. Feeding of the sheet S is started in this state.

Controller

FIG. 15 is a control block diagram according to the present exemplary embodiment. The apparatus body 1A is provided with a controller 70. As illustrated in FIG. 15, the controller 70 includes a central processing unit: CPU 71, a read only memory: ROM 72, and a random access memory: RAM 73. The ROM 72 stores a program for controlling each component, and the RAM 73 temporarily stores data. The motor 27 is connected to the output side of the controller 70. The sheet surface detection sensor 60 and a cassette presence sensor 74 are connected to the input side of the controller 70. The sheet surface detection sensor 60 detects the position of an upper surface of the sheet S on the inner plate 33. The cassette presence sensor 74 serving as a detection portion detects the cassette 5 having been attached to the apparatus body 1A and the cassette 5 having been drawn out from the apparatus body 1A. The sheet surface detection sensor 60 and the cassette presence sensor 74 are each constituted by, for example, a switch sensor or an optical sensor.

Action of Holder, Inner Plate, and Peripheral Components Thereof

Figure 8:
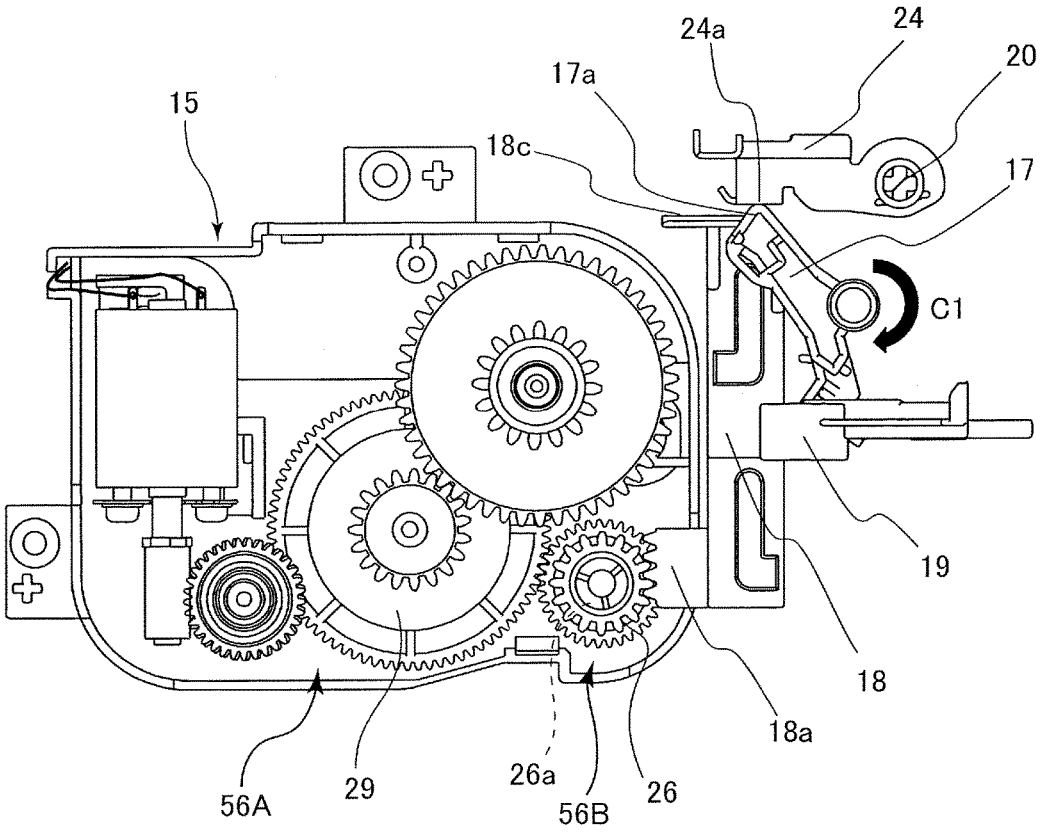
FIG. 8 is a section view of a first link member and a second link member in a state in which the cassette has been drawn out taken along a plane F of FIG. 4.

Next, action of the holder 22, the inner plate 33, and peripheral components thereof will be described. In a state in which the cassette 5 is attached to the apparatus body 1A, the first link member 17 is pressed by the cassette 5 via the lever member 19, and thus the first pressing surface 17*a* is positioned at the lowest position and the second link member 18 is held at the allowing position. When the cassette 5 is drawn out from the apparatus body 1A, the cassette 5 is separated from the lever member 19 as illustrated in FIG. 8. Then, the pressurization by the lever member 19 on the first link member 17 is cancelled, and the first link member 17 is pivoted in the C1 direction by the torsion coil spring 54 illustrated in FIG. 4. As a result of the first link member 17 pivoting in the C1 direction, the first pressing surface 17*a* of the first link member 17 presses the side end portion 24*a* of the pushing plate 24 upward, and thus moves the pickup roller 6 to the separated position via the holder 22 as illustrated in FIG. 9. At the separated position of the pickup roller 6, the holder 22 comes into contact with an unillustrated stopper provided in the apparatus body 1A, and is thus positioned. To be noted, when the pickup roller 6 is positioned at the separated position, the pickup roller 6 is positioned so as not to interfere with the sheet S supported on the inner plate 33.

At this time, the second pressing surface 17*b* of the first link member 17 presses the first contact surface 18*b* of the second link member 18, and the second link member 18 moves to the holding position. At this time, although the rack portion 18*a* of the second link member 18 drives the one-way gear 26, the one-way clutch 26*a* included in the one-way gear 26 prevents the drive from being transmitted from the one-way gear 26 to the intermediate gear 29. Therefore, the driving force is not transmitted to the lifter driving gear 28 or the worm wheel 25*b* via the intermediate gear 29 when the cassette 5 is drawn out. In addition, when the second link member 18 is positioned at the holding position, the elastic force of the torsion coil spring 53 is applied from the pushing plate 24 in such a direction as to push down the second link member 18. However, since the second link member 18 is urged upward via the first link member 17 by the torsion coil spring 54 having a larger elastic force than the torsion coil spring 53, the second link member 18 remains at the holding position.

Meanwhile, when the cassette 5 is drawn out from the apparatus body 1A, the lifter gear 30 is separated from the lifter driving gear 28 together with the cassette 5. As a result of this, the inner plate 33 of the cassette 5 descends due to its own weight. At this time, since the driving force is not transmitted to the lifter driving gear 28 as described above, the friction between the lifter driving gear 28 and the lifter gear 30 is small, and the cassette 5 can be easily drawn out.

Figure 10:
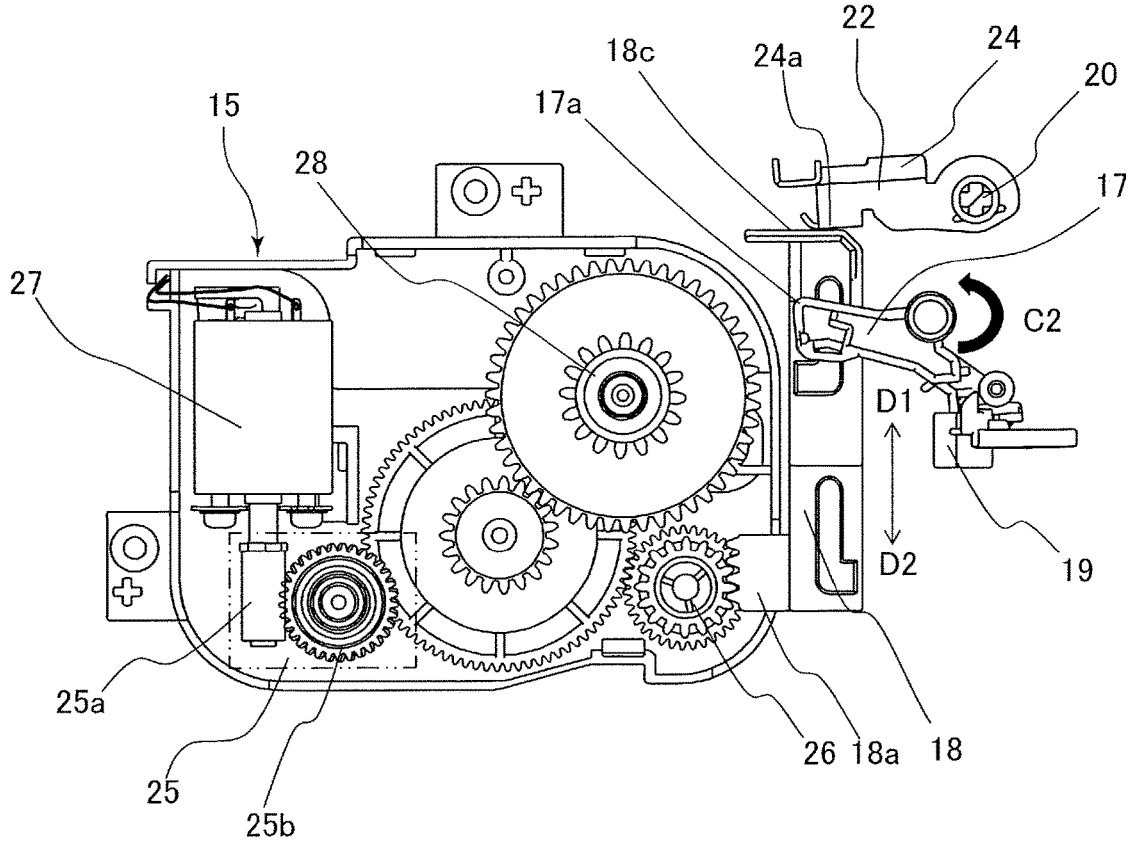
FIG. 10 is a section view of the first link member and the second link member immediately before the cassette is attached taken along the plane F of FIG. 4.

At the time of attaching the cassette 5 to the apparatus body 1A, the downstream end of the cassette 5 in an insertion direction comes into contact with the contact portion 19*a* of the lever member 19 immediately before the cassette 5 is attached to the apparatus body 1A. As a result of this, the lever member 19 pivots in the E1 direction illustrated in FIG. 4, and, along with this, the first link member 17 pivots in the C2 direction as illustrated in FIG. 10. Thus, the first pressing surface 17*a* of the first link member 17 is separated from the side end portion 24*a* of the pushing plate 24. At this time, the pushing plate 24 and the holder 22 slightly swing downward due to the urging force of the torsion coil spring 53, and thus come into contact with and is held by the second contact surface 18*c* of the second link member 18 positioned at the holding position. Although force to push down the second link member 18 is applied to the second link member 18 by its own weight and the urging force of the torsion coil spring 53, the second link member 18 is held at the holding position due to the large reduction ratio of the worm gear pair 25. That is, self-locking occurs due to the worm gear pair 25, and the second link member 18 is held at the holding position. The position to which the pushing plate 24 and the holder 22 have slightly swung is also a separated position at which the pickup roller 6 does not interfere with the sheet S supported on the inner plate 33.

To be noted, a configuration in which, in a state in which the cassette 5 has been drawn out, the second contact surface 18*c* of the second link member 18 also comes into contact with the side end portion 24*a* of the pushing plate 24 together with the first pressing surface 17*a* of the first link member 17 may be employed. In this configuration, the pushing plate 24 and the holder 22 do not slightly swing downward even when the first link member 17 is separated from the pushing plate 24. In addition, a configuration in which the first link member 17 is directly pivoted in the C2 direction by the cassette 5 without using the lever member 19 may be employed. For example, the first link member 17 may be rotated in the C2 direction by directly pressing the pressed portion 17*c* of the first link member 17 by, for example, an inclined surface provided on the cassette 5, and thus causing the pressed portion 17*c* to swing in a direction perpendicular to the attachment direction of the cassette 5.

Figure 11:
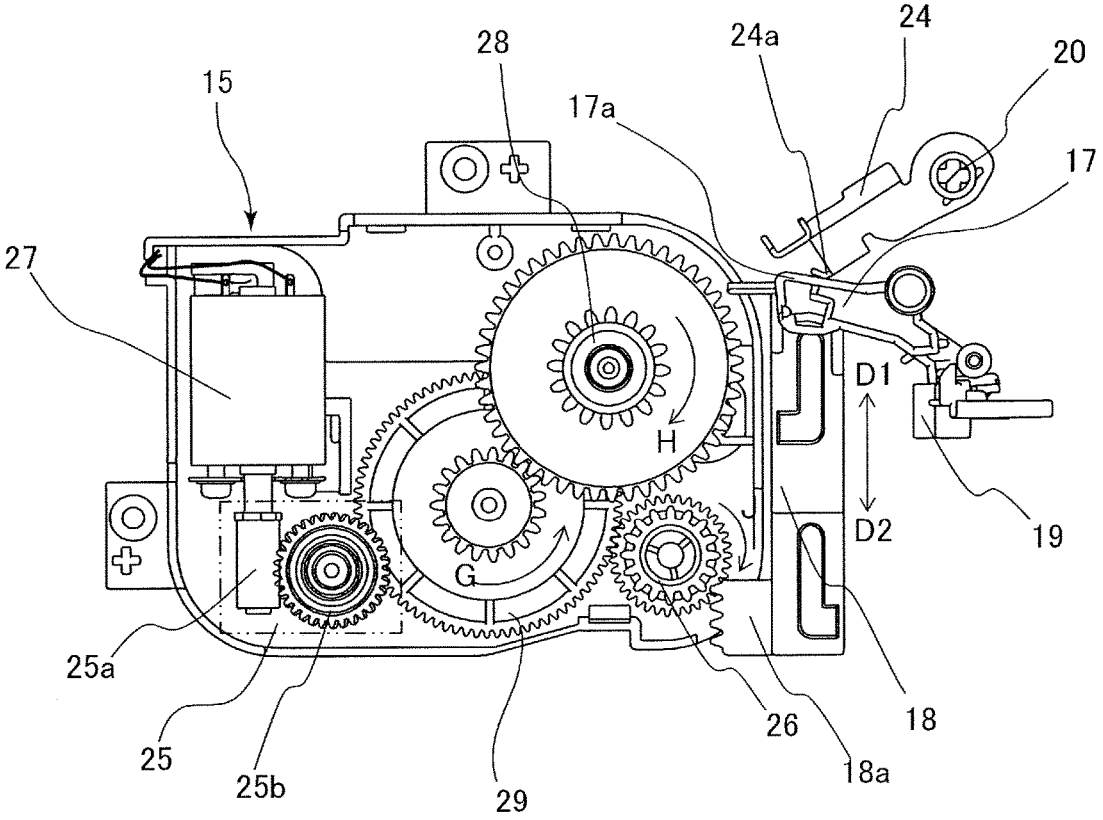
FIG. 11 is a section view of the first link member and the second link member in a state in which the cassette has been attached taken along the plane F of FIG. 4.

When the cassette 5 is attached to the apparatus body 1A and the attachment of the cassette 5 is detected by, for example, the cassette presence sensor 74 illustrated in FIG. 15, the motor 27 is driven. When the motor 27 is driven, the intermediate gear 29, the lifter driving gear 28, and the one-way gear 26 respectively rotate in an arrow G direction, an arrow H direction, and an arrow J direction as illustrated in FIG. 11. The rotation of the lifter driving gear 28 in the arrow H direction causes the inner plate 33 to ascend as described above. In addition, the rotation of the one-way gear 26 in the J direction causes the second link member 18 to move from the holding position toward the allowing position in the D2 direction via the rack portion 18*a*. When the second link member 18 descends, the rack portion 18*a* passes through the one-way gear 26 and the engagement is cancelled in the middle of the descent. Then, the second link member 18 is stopped and remains at the allowing position as a result of the first contact surface 18*b* coming into contact with the second pressing surface 17*b* of the first link member 17.

As a result of the second link member 18 moving in the D2 direction, the pushing plate 24 and the holder 22 urged downward by the torsion coil spring 53 pivots downward following the second link member 18 as illustrated in FIG. 12. The pushing plate 24 stops by coming into contact with the first pressing surface 17*a* of the first link member 17. In this state of the allowing position, the pickup roller 6 is positioned at the lower position below the feeding position. Meanwhile, when the motor 27 is driven and the inner plate 33 is caused to ascend by the rotation of the lifter driving gear 28, a sheet on the inner plate 33 comes into contact with and lifts up the pickup roller 6 that has moved to a position below the feeding position to the feeding position. At this time, the pickup roller 6 is brought into pressure contact with the upper surface of the sheet S by the elastic force of the torsion coil spring 53 via the pushing plate 24 and the holder 22, and a sheet feeding pressure between the pickup roller 6 and the sheet S is thus set. Since the pickup roller 6 moves to the feeding position after the attachment of the cassette 5 has been completed as described above, wrinkles and tear of the sheet S caused by the pickup roller 6 coming into contact with the sheet S during the attachment of the cassette 5 can be prevented.

The drive of the sheet feeding motor 40 is transmitted to the pickup roller 6 at predetermined intervals in a state in which the pickup roller 6 is in pressure contact with the sheet S, and thus the pickup roller 6 is capable of consecutively sending out sheets. In the case where the top surface of sheets S descends due to reduction of sheets S and the pickup roller 6 is displaced from the feeding position, the sheet surface detection sensor 60 no longer detects the flag member 60*a* provided on the holder 22. In this case, the controller 70 performs control, on the basis of a detection signal from the sheet surface detection sensor 60, to move the pickup roller 6 to the feeding position by driving the motor 27. To be noted, in a state in which the inner plate 33 is lifted up by the ascending portion 31C, the inner plate 33 does not descend and is held due to the reduction ratio of the worm gear pair 25.

As described above, in the present exemplary embodiment, the second transmission portion 56B that branches from the first transmission portion 56A configured to transmit the driving force to cause the inner plate 33 to ascend and is constituted by the one-way gear 26 is provided, and the second link member 18 is configured to be moved by the one-way gear 26. Therefore, the driving force from the motor 27 is transmitted to the inner plate 33 through the first transmission portion 56A, and is also transmitted to the second link member 18 through the one-way gear 26, and thus the ascending and descending operations of the pickup roller 6 are realized. Therefore, the ascending and descending operations of the moving portion 55 and the lift-up plate 31 can be realized by the single motor 27 without requiring a dedicated actuator for causing the pickup roller 6 to ascend and descend, and thus the costs can be reduced.

In addition, the pickup roller 6 can be positioned by the lever member 19 and the second link member 18 so as not to interfere with the sheet S when inserting the cassette 5 in the apparatus body 1A, and thus a jam can be prevented. In addition, since the motor 27 does not rotate in a reverse direction, there is no necessity to provide an additional electrical circuit or the like.

Second Exemplary Embodiment

Next, a second exemplary embodiment of the present invention will be described. The second exemplary embodiment is configured without the lever member 19 and the first link member 17 of the first exemplary embodiment. Therefore, the illustration of the same elements as the first exemplary embodiment will be omitted or given by using the same reference signs.

Link Member

Figure 13:
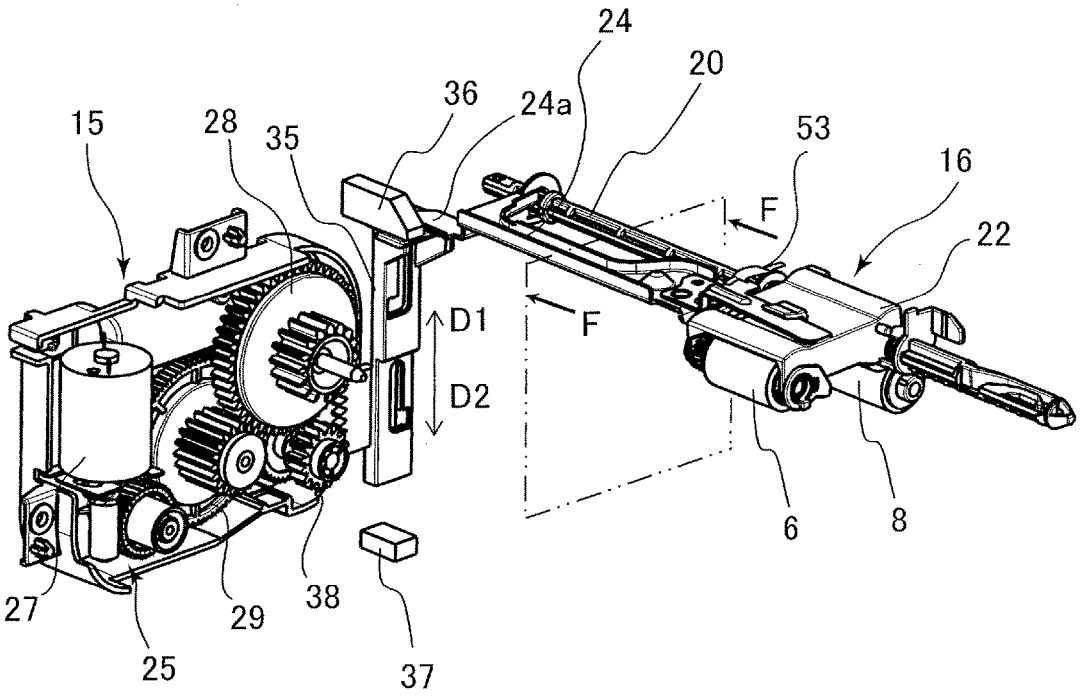
FIG. 13 is a perspective view of a drive unit and a roller unit according to a second exemplary embodiment.
Figure 14:
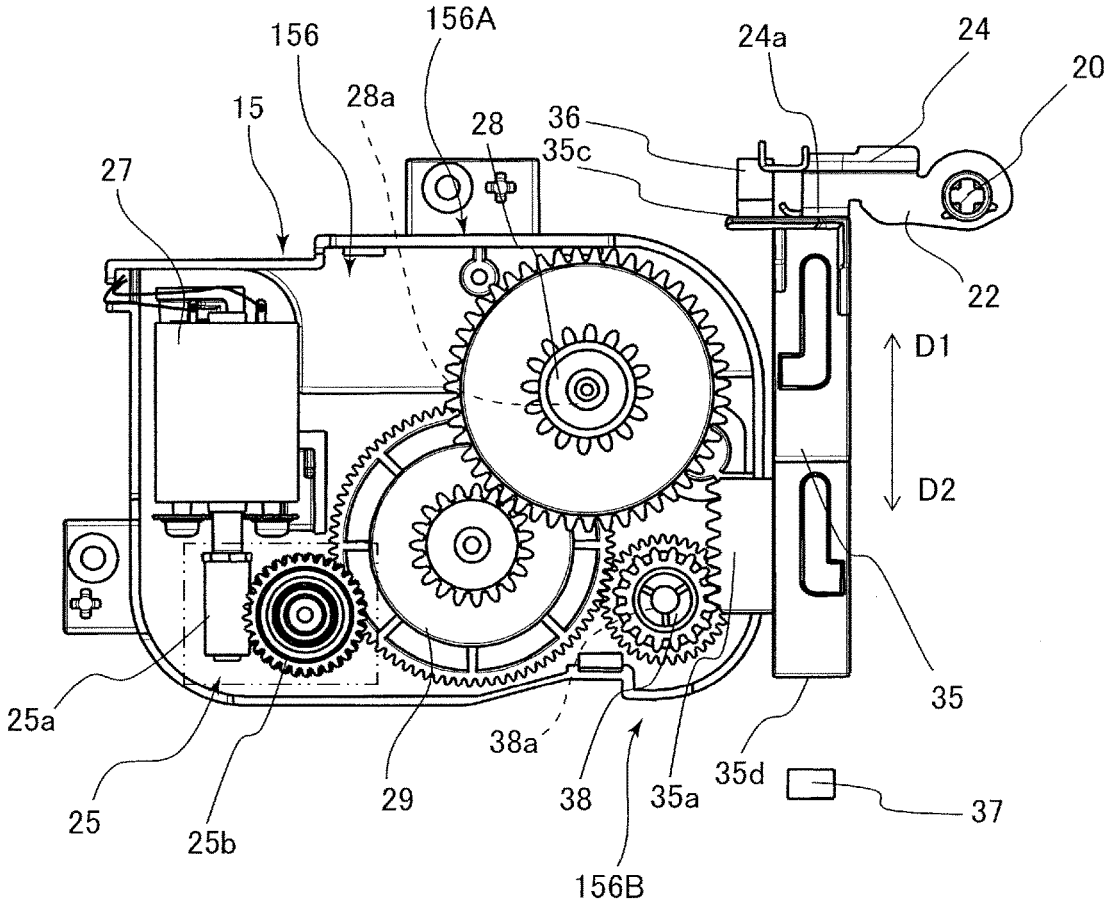
FIG. 14 is a section view of a link member taken along a plane F of FIG. 13.

As illustrated in FIG. 13, a link member 35 is interposed between the drive unit 15 and the roller unit 16. The link member 35 serving as a holding portion is provided with a rack portion 35*a* formed thereon as illustrated in FIG. 14, and the rack portion 35*a* is engaged with a link driving gear 38 coupled to a torque limiter 38*a*. The driving force from the motor 27 is input to the link driving gear 38 through the worm gear pair 25 and the intermediate gear 29.

The link member 35 is supported so as to be movable in the D1 direction and the D2 direction by the driving force from the motor 27, an upper surface portion 35*c* thereof is capable of coming into contact with a first stopper 36 by moving in the D1 direction, and a lower surface portion 35*d* thereof is capable of coming into contact with a second stopper 37 by moving in the D2 direction. The first stopper 36 serving as a first movement regulation portion comes into contact with the link member 35 positioned at the holding position, and regulates the movement of the link member 35 in a first movement direction, that is, the arrow D1 direction, opposite to the direction from the holding position to the allowing position. The second stopper 37 serving as a second movement regulation portion comes into contact with the link member 35 positioned at the allowing position, and regulates the movement of the link member 35 in a second movement direction, that is, the arrow D2 direction, opposite to the direction from the allowing position to the holding position. In addition, the torque limiter 38*a* does not transmit the driving force from the motor 27 that moves the link member 35 in the arrow D1 direction to the link member 35 in a state in which the link member 35 is in contact with the first stopper 36. Further, the torque limiter 38*a* does not transmit the driving force from the motor 27 that moves the link member 35 in the arrow D2 direction to the link member 35 in a state in which the link member 35 is in contact with the second stopper 37.

Drive Unit

The drive unit 15 includes the motor 27, the worm gear pair 25, the intermediate gear 29, the lifter driving gear 28, the link driving gear 38, and the lifter gear 30 illustrated in FIG. 7. The motor 27 is capable of driving in a first direction and a second direction opposite to the first direction. The worm gear pair 25, the intermediate gear 29, the lifter driving gear 28, the link driving gear 38, and the lifter gear 30 constitute a transmission unit 156. In addition, the worm gear pair 25, the intermediate gear 29, the lifter driving gear 28, and the lifter gear 30 constitute a first transmission portion 156A, and the link driving gear 38 constitutes a second transmission portion 156B branching from the first transmission portion 156A.

Controller

In a control block diagram according to the second exemplary embodiment, the program for driving the motor 27 stored in the ROM 72 is different from the control block diagram of FIG. 15 described in the first exemplary embodiment. This program will be described with reference to a flowchart of FIG. 16.

Action of Holder and Inner Plate

Figure 16:
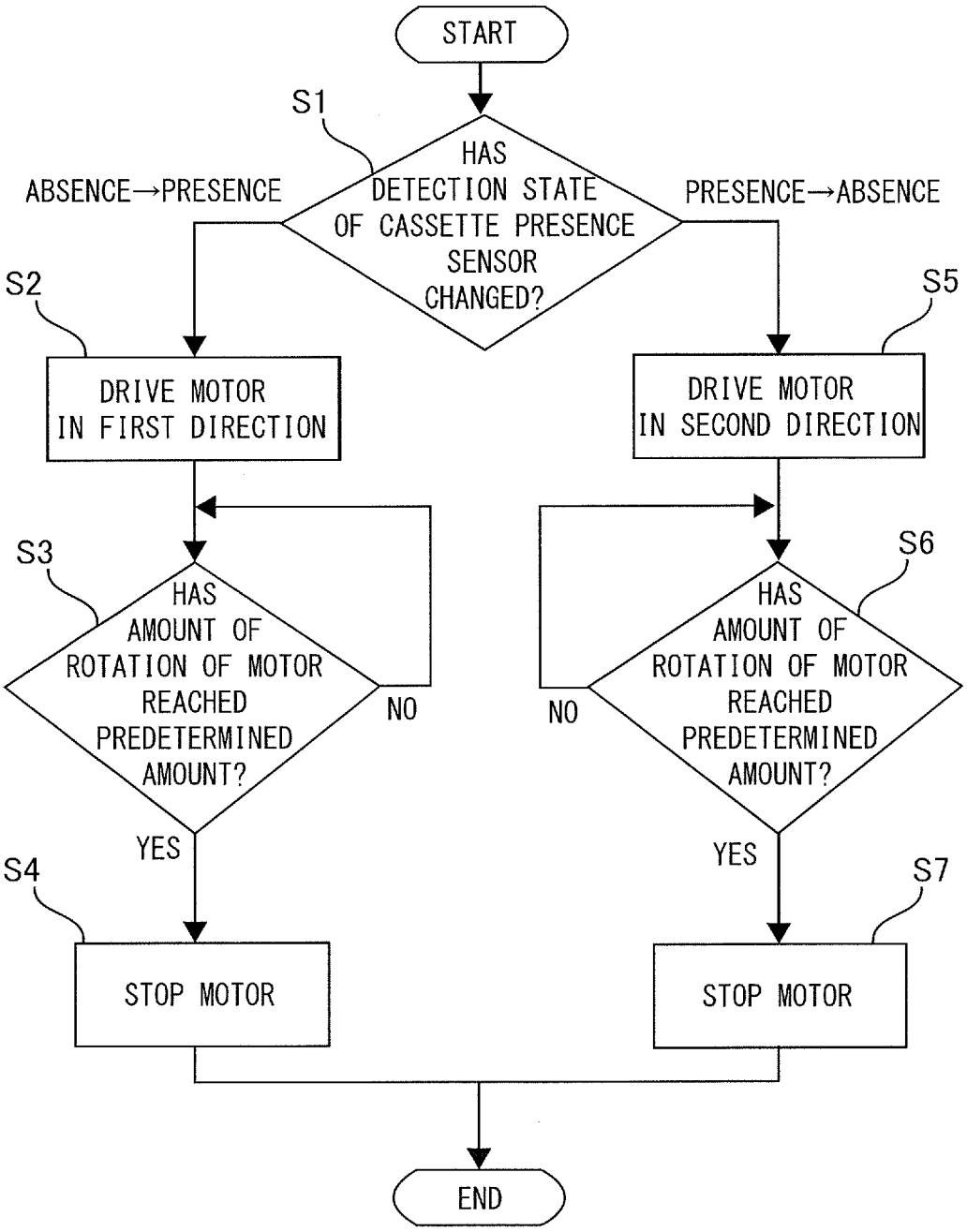
FIG. 16 is a flowchart for describing action of a holder and an inner plate.

Next, action of the holder 22 and the inner plate 33 when the cassette 5 is attached to and drawn out from the apparatus body 1A will be described in accordance with the flowchart of FIG. 16. First, in step S1, the controller 70 determines whether a detection state of the cassette presence sensor 74 has changed. At this time, the controller 70 determines change from a drawn-out state to an attached state of the cassette 5 and change from the attached state to the drawn-out state on the basis of the results of detection of the cassette presence sensor 74. In FIG. 16, the drawn-out state is indicated by "absence", and the attached state is indicated by "presence".

Figure 17:
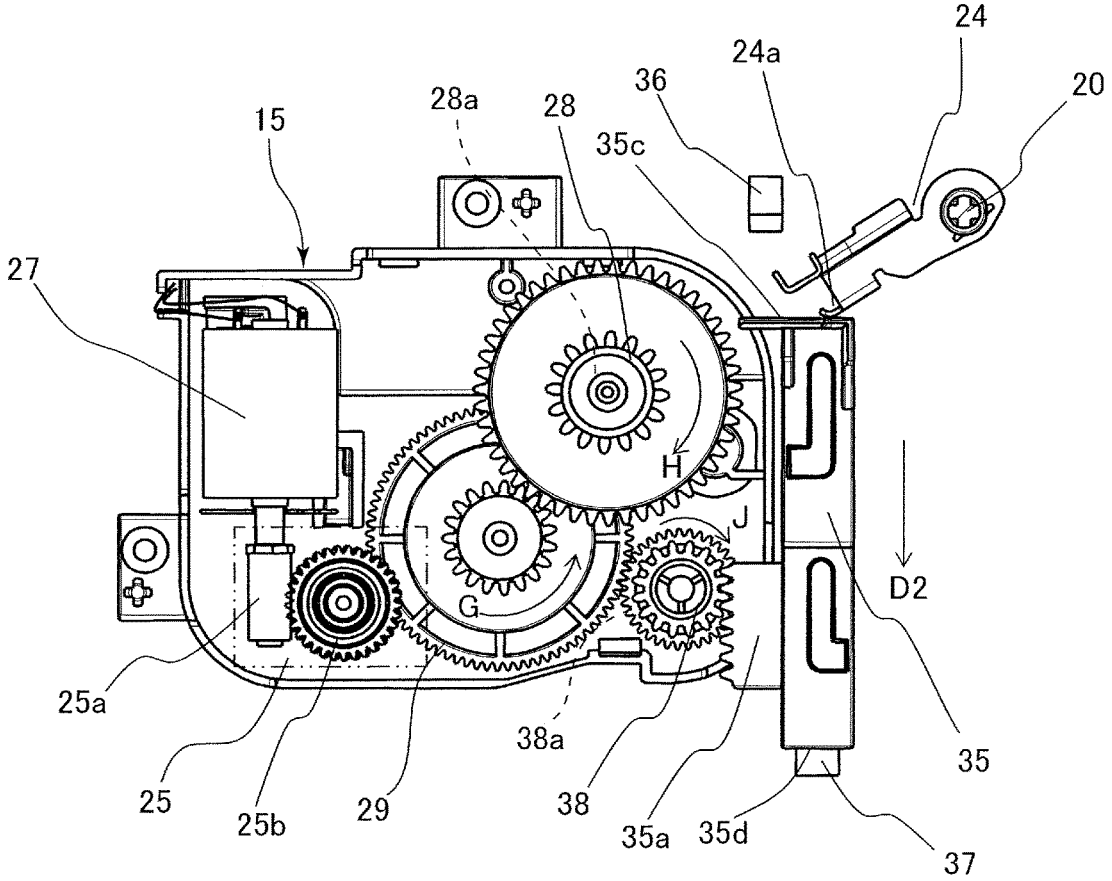
FIG. 17 is a section view of the link member in a state in which the cassette has been attached taken along the plane F of FIG. 13.

In the case where it is determined that the detection state of the cassette presence sensor 74 has changed from "absence" to "presence" in step S1, that is, where the cassette 5 has been attached to the apparatus body 1A, the controller 70 drives the motor 27 in the first direction in step S2. When the motor 27 is driven in the first direction, the intermediate gear 29, the lifter driving gear 28, and the link driving gear 38 respectively rotate in the arrow G direction, arrow H direction, and arrow J direction as illustrated in FIG. 17. The rotation of the lifter driving gear 28 in the arrow H direction causes the inner plate 33 to ascend as described above. To be noted, a one-way clutch 28*a* is coupled to the lifter driving gear 28. The one-way clutch 28*a* transmits the driving force of the motor 27 in the first direction to the lifter gear 30 and the lift-up plate 31, and does not transmit the driving force of the motor 27 in the second direction to the lifter gear 30 and the lift-up plate 31.

Therefore, the driving force of the motor 27 driving in the first direction is transmitted from the lifter driving gear 28 to the lifter gear 30, and the lift-up plate 31 and the inner plate 33 ascend. In addition, the rotation of the link driving gear 38 in the J direction moves the link member 35 in the D2 direction from the holding position toward the allowing position. The movement of the link member 35 in the D2 direction is regulated by the lower surface portion 35*d* being in contact with the second stopper 37 at the allowing position. Following the movement of the link member 35 toward the allowing position, the pushing plate 24 and the holder 22 are moved by the urging force of the torsion coil spring 53, and thus move the pickup roller 6 to the feeding position. As a result of this, the pickup roller 6 comes into contact with the sheet S on the inner plate 33, and thus becomes capable of feeding the sheet S.

Even in the case where the motor 27 further drives in the first direction in this state, the torque limiter 38*a* of the link driving gear 38 idles, and therefore the driving force of the motor 27 is not transmitted to the link member 35. As a result of this, tooth jump of the link driving gear 38 and the rack portion 35*a* and stepping out of the motor 27 can be prevented. Then, in steps S3 and S4, the controller 70 stops the motor 27 after driving the motor 27 by a predetermined amount, and finishes the processing.

Figure 18:
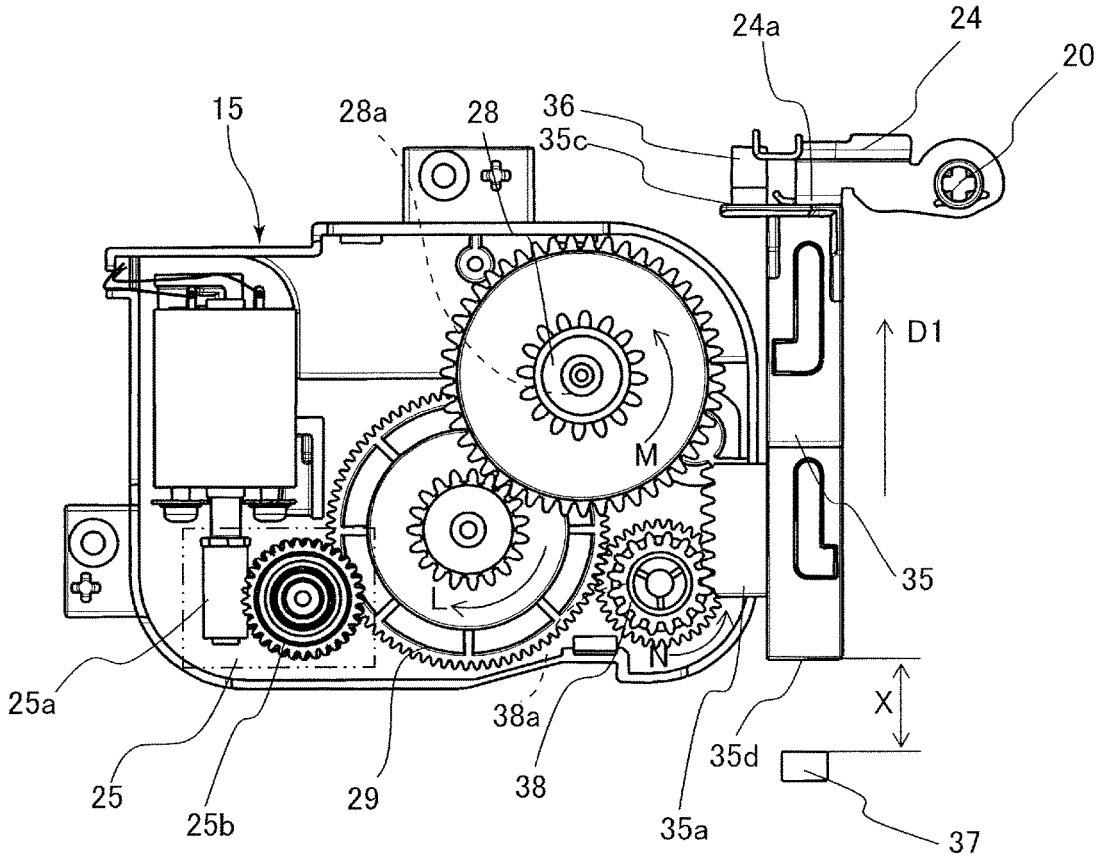
FIG. 18 is a section view of the link member in a state in which the cassette has been drawn out taken along the plane F of FIG. 13.

In contrast, in the case where it is been determined that the detection state of the cassette presence sensor 74 has changed from "presence" to "absence" in step S1, that is, where the cassette 5 has been drawn out from the apparatus body 1A, the controller 70 drives the motor 27 in the second direction in step S5. When the motor 27 is driven in the second direction, the intermediate gear 29, the lifter driving gear 28, and the link driving gear 38 respectively rotate in an arrow L direction, an arrow M direction, and an arrow N direction as illustrated in FIG. 18. Since the drive from the lifter driving gear 28 to the lifter gear 30 is blocked by the one-way clutch 28*a*, the lifter gear 30 does not move. When the cassette 5 is drawn out from the apparatus body 1A, the lifter gear 30 is separated from the lifter driving gear 28 together with the cassette 5. As a result of this, the inner plate 33 of the cassette 5 descends due to its own weight. At this time, since the drive from the lifter driving gear 28 is not transmitted to the lifter gear 30 as described above, the friction between the lifter driving gear 28 and the lifter gear 30 is small, and the cassette 5 can be easily drawn out.

Then, the rotation of the link driving gear 38 in the N direction moves the link member 35 in the D1 direction from the allowing position toward the holding position. The movement of the link member 35 in the D1 direction is regulated by the upper surface portion 35*c* being in contact with the first stopper 36 at the holding position. The pushing plate 24 and the holder 22 swing against the urging force of the torsion coil spring 53 so as to move the pickup roller 6 to the separated position by being pressed by the upper surface portion 35*c* of the link member 35 moving to the holding position. As a result of this, the pickup roller 6 moves to such a position as not to be in contact with the sheet S on the inner plate 33.

Even in the case where the motor 27 further drives in the second direction in this state, the torque limiter 38*a* of the link driving gear 38 idles, and therefore the link member 35 is not moved by the driving force of the motor 27. This torque limiter 38*a* prevents tooth jump of the link driving gear 38 and the rack portion 35*a* and stepping out of the motor 27. Then, in steps S6 and S7, the controller 70 stops the motor 27 after driving the motor 27 by a predetermined amount, and finishes the processing. To be noted, even in the case where the power supply to the motor 27 is stopped, the link member 35 is held at the holding position against its own weight and the urging force of the torsion coil spring 53 by the self-locking function of the large reduction ratio of the worm gear pair 25.

In addition, in the present exemplary embodiment, a distance X between the lower surface portion 35*d* of the link member 35 and the second stopper 37 is set to 15 mm in a state in which the link member 35 is positioned at the holding position. Further, the predetermined amount by which the motor 27 is driven in step S3 or S6 is set to such an amount as to move the link member 35 by 20 mm in the D1 direction or the D2 direction. As a result of this, even in the case where there is a variation in the dimensions of the components or the like, the link member 35 securely comes into contact with the first stopper 36 or the second stopper 37 by driving the motor 27, and thus the link member 35 can be securely positioned at the holding position or the allowing position.

As described above, in the present exemplary embodiment, the second transmission portion 156B that branches from the first transmission portion 156A configured to transmit the driving force to lift the inner plate 33 and is constituted by the link driving gear 38 is provided, and the link driving gear 38 is configured to cause the link member 35 to ascend and descend. In addition, the motor 27 drives in the first direction and the second direction in accordance with the attachment and detachment operations of the cassette 5, the driving force of the motor 27 causes the link member 35 to ascend and descend, and thus the ascending and descending operations of the pickup roller 6 are realized. Therefore, a dedicated actuator for causing the pickup roller 6 to ascend and descend is not required, and thus the costs can be reduced.

Third Exemplary Embodiment

Next, a third exemplary embodiment of the present invention will be described. In the third exemplary embodiment, the transmission unit 56 of the first exemplary embodiment is provided with a delay mechanism 85 in order to securely detect the pickup roller 6 at the feeding position. Therefore, illustration of the same elements as the first exemplary embodiment will be omitted or given by using the same reference signs.

In order to detect the pickup roller 6 at the feeding position, the pickup roller 6 needs to be moved down in advance before the inner plate 33 ascends and the pickup roller 6 comes into contact with the sheet S on the inner plate 33. For example, in the case where the pickup roller 6 comes into contact with the sheet S in a state in which the pickup roller 6 is positioned above the feeding position, the pickup roller 6 ascending together with the sheet S cannot be detected at the feeding position. Therefore, in the present exemplary embodiment, the transmission unit 56 is provided with the delay mechanism such that the lift-up plate 31 starts driving after start of movement of the second link member 18.

Delay Mechanism

Figure 19C:
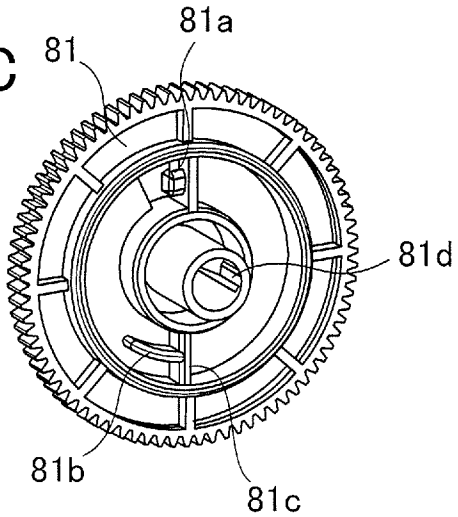
FIG. 19C is a perspective view of a first gear.
Figure 19D:
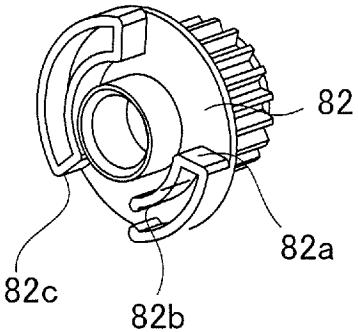
FIG. 19D is a perspective view of a second gear.
Figure 19B:
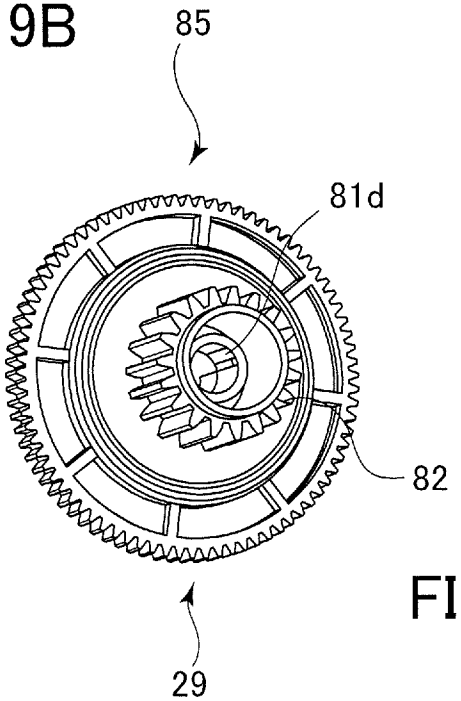
FIG. 19B is a perspective view of the delay mechanism.
Figure 19A:
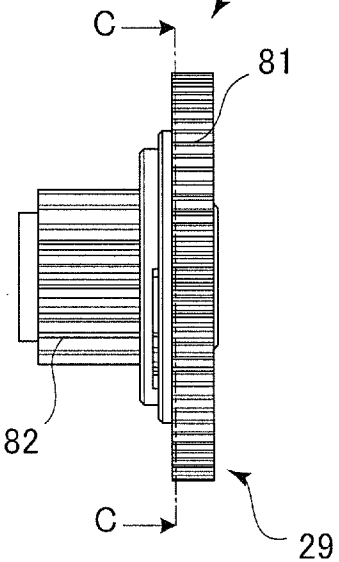
FIG. 19A is a side view of a delay mechanism according to a third exemplary embodiment.
Figures 20A, 20B, 20C:
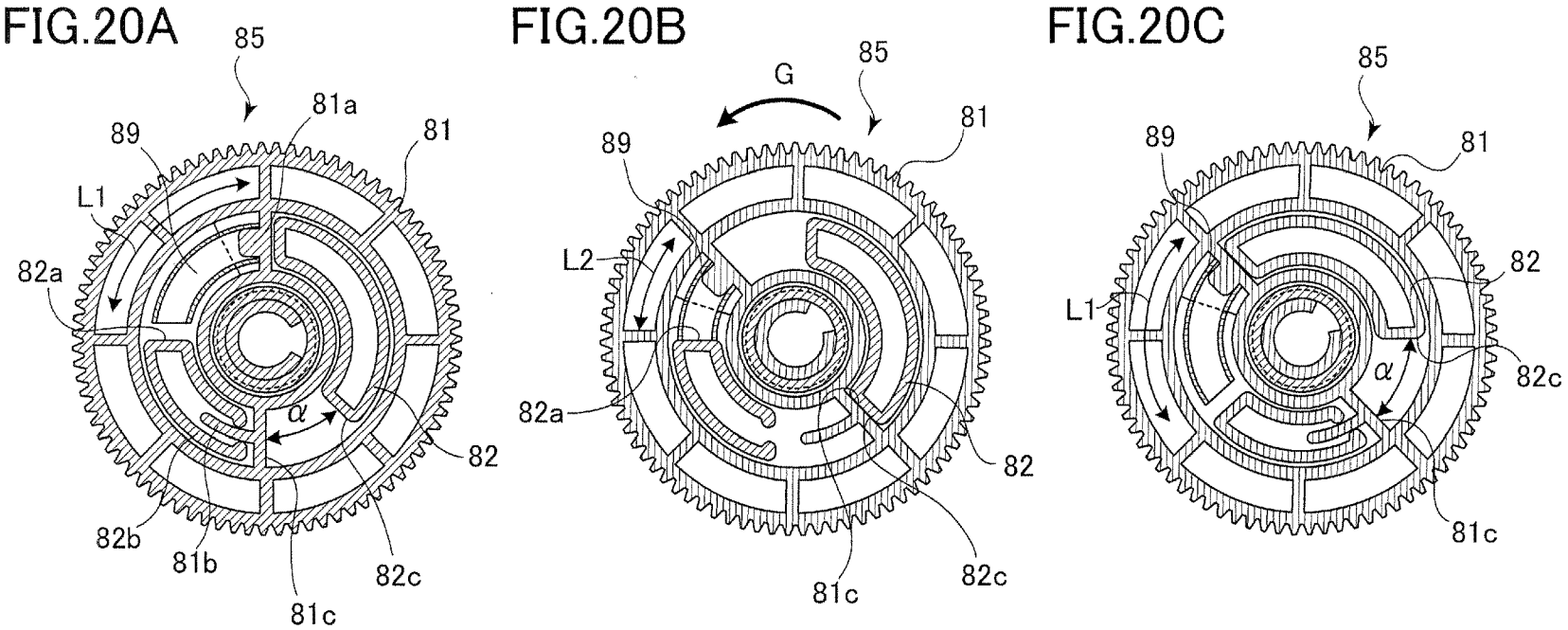
FIG. 20A is a section view of the delay mechanism in a state in which a motor is not driving taken along a plane C of FIG. 19A.
FIG. 20B is a section view of the delay mechanism in a state in which the motor is driving taken along the plane C of FIG. 19A.
FIG. 20C is a section view of the delay mechanism in a state in which the cassette has been drawn out from the apparatus body taken along the plane C of FIG. 19A.

As illustrated in FIGS. 19A and 19B, the delay mechanism 85 is constituted by the intermediate gear 29 and a coil spring 89 included in the intermediate gear 29 illustrated in FIG. 20A. The intermediate gear 29 includes a first gear 81 and a second gear 82. The first gear 81 is disposed in a drive transmission path between the motor 27 and the second link member 18. The second gear 82 is disposed coaxially with the first gear 81, and is disposed in a drive transmission path between the motor 27 and the lift-up plate 31.

The first gear 81 includes a boss 81*a*, a rib 81*b*, and a first contact surface 81*c* formed thereon as illustrated in FIG. 19C, and the coil spring 89 serving as a gear urging member is firmly fit on the boss 81*a*. The second gear 82 includes a spring bearing 82*a*, an insertion portion 82*b*, and a second contact surface 82*c* formed thereon as illustrated in FIG. 19D. The coil spring 89 is capable of coming into contact with the spring bearing 82*a*, the rib 81*b* of the first gear 81 is to be inserted in the insertion portion 82*b*, and the second contact surface 82*c* is capable of coming into contact with and being separated from the first contact surface 81*c*. The rib 81*b* of the first gear 81 and the insertion portion 82*b* of the second gear 82 are ribs for suppressing erroneous assembly provided for correct assembly of the first gear 81 and the second gear 82. To be noted, a configuration in which only one of the rib 81*b* and the insertion portion 82*b* is provided may be employed. The rib 81*b* and the insertion portion 82*b* constitute a regulation rib that regulates an attachment phase of the second gear 82 to the first gear 81. The second gear 82 is attached to the first gear 81 by a snap fit 81*d* provided on the first gear 81 in a state in which the rib 81*b* is inserted in the insertion portion 82*b*. At this time, as illustrated in FIG. 20A, the second gear 82 is capable of relatively rotating with respect to the first gear 81 within the range of an angle $\alpha$ between the first contact surface 81*c* and the second contact surface 82*c*.

FIG. 20A is a section view of the delay mechanism 85 in a state in which the cassette 5 is attached to the apparatus body 1A and the motor 27 is not driving taken along a C plane indicated in FIG. 19A. FIG. 20B is a section view of the delay mechanism 85 in a state in which the inner plate 33 is fully loaded with sheets and the motor 27 is driving taken along the C plane indicated in FIG. 19A. FIG. 20C is a section view of the delay mechanism 85 in a state in which the cassette 5 has been drawn out from the apparatus body 1A.

As illustrated in FIG. 20A, in the state in which the cassette 5 is attached to the apparatus body 1A and the motor 27 is driving, the first contact surface 81*c* of the first gear 81 and the second contact surface 82*c* of the second gear 82 are not in contact with each other. In addition, a natural length L1 of the coil spring 89 is set to such a length that the coil spring 89 is not nipped between the first gear 81 and the second gear 82 in the axial direction at the time of mounting the second gear 82 on the first gear 81.

In addition, in a state in which the cassette 5 has been attached to the apparatus body 1A, the lifter driving gear 28 is engaged with the lifter gear 30, and thus load torque in a direction opposite to the direction of rotation by the drive of the motor 27 is applied to the second gear 82. This load torque occurs due to, for example, sliding resistance of a gear train of the lifter driving gear 28 and the lifter gear 30 and the weight of the lift-up plate 31, the inner plate 33, and sheets. To be noted, also in a state in which no sheet is supported on the inner plate 33, the load torque is applied to the second gear 82 due to, for example, the sliding resistance of the gear train and the weight of the lift-up plate 31 and the inner plate 33. That is, the load torque takes a value that changes mainly in accordance with the weight of sheets, that is, the amount of supported sheets.

For example, as illustrated in FIG. 20B, the first gear 81 rotates in an arrow G direction when the motor 27 is driven in a state where the inner plate 33 is fully loaded with sheets. At this time, the position of the second gear 82 is maintained by the load torque described above, and the coil spring 89 contracts between the first gear 81 and the second gear 82 due to the rotation of the first gear 81. That is, the urging force derived from the elastic force of the coil spring 89 applied to the second gear 82 increases in accordance with the rotation of the first gear 81, and the second gear 82 is rotated in the arrow G direction by the pressure from the coil spring 89 when the urging force surpasses the load torque applied to the second gear 82.

In the state in which the inner plate 33 is fully loaded with sheets, the urging force of the coil spring 89 does not surpass the load torque applied to the second gear 82, the first gear 81 rotates by the angle α, and the first contact surface 81*c* comes into contact with the second contact surface 82*c*. At this time, a length L2 of the coil spring 89 is set to be equal to or larger than the solid height of the coil spring 89. The solid height refers to a height of the coil spring 89 in a state in which all spring lines of the coil spring 89 are in contact with one another. In addition, since it is set that the second link member 18 moves to the allowing position illustrated in FIG. 10 as a result of the first gear 81 rotating by the angle α, the pickup roller 6 is positioned at the lower position.

To be noted, although the pickup roller 6 passes the feeding position in the course of the first gear 81 rotating by the angle α, the controller 70 neglects, for example, for a predetermined time after the motor 27 is turned on, an ON signal from a sheet surface detection sensor 84 even in the case where the sheet surface detection sensor 84 has detected a flag member 83. As a result of this, the controller 70 does not stop the motor 27 even in the case where the pickup roller 6 passes the feeding position in the course of moving from the separated position to the lower position after the motor 27 is turned on. In addition, a configuration in which the sheet surface detection sensor 84 includes two detection elements arranged in the vertical direction and transmits an ON signal to the controller 70 only when the moving portion 55 is ascending may be employed.

Then, in the case where the motor 27 rotates further in the state in which the first contact surface 81*c* is in contact with the second contact surface 82*c*, the delay mechanism 85 rotates in a state in which the first gear 81 and the second gear 82 are integrated. This state in which the first gear 81 and the second gear 82 rotate integrally will be referred to as a second state, and a state in which the first gear 81 rotates and the second gear 82 does not rotate will be referred to as a first state. In the second state, the rotation of the second gear 82 causes the inner plate 33 to ascend, and the upper surface of the sheet S on the inner plate 33 comes into contact with the pickup roller 6. In the case where the second gear 82 further rotates, the moving portion 55 ascends following the sheet S on the inner plate 33 against the urging force of the torsion coil spring 53. Then, in the case where the sheet surface detection sensor 84 detects that the pickup roller 6 is positioned at the feeding position, the controller 70 stops the motor 27. Due to the large reduction ratio of the worm gear pair 25 acting on the second gear 82, the second link member 18 does not move even after the motor 27 is stopped unless the cassette 5 is drawn out from the apparatus body 1A.

To be noted, in the second state, since the first gear 81 rotates together with the second gear 82, force to move the second link member 18 downward remains being applied to the second link member 18, due to the drive of the motor 27 until the motor 27 is stopped, even after the pickup roller 6 is positioned at the lower position. Therefore, for example, a configuration in which the rack portion 18*a* of the second link member 18 is constituted by a partially toothed gear and a non-toothed portion of the partially toothed gear opposes the one-way gear 26 when the second link member is positioned at the allowing position may be employed. As a result of this, the driving force from the one-way gear 26 is no longer transmitted to the second link member 18 when the second link member 18 is positioned at the allowing position. In addition, the rack portion 18*a* may be configured to be separated from the one-way gear 26 in the course of the second link member 18 descending to the allowing position, and a stopper to stop the second link member 18 at the allowing position may be provided.

In addition, in the case where no sheet is supported on the inner plate 33 or only a few sheets are supported on the inner plate 33, the second gear 82 starts rotating together with the first gear 81 before the first contact surface 81*c* comes into contact with the second contact surface 82*c*. To be noted, these cases will be hereinafter collectively referred to as a "case where the number of supported sheets is small" including the case where no sheet is supported. When the first gear 81 rotates, the coil spring 89 contracts, and the urging force applied from the coil spring 89 to the spring bearing 82*a* of the second gear 82 increases. Then, when this urging force surpasses the load torque applied to the second gear 82, the first gear 81 and the second gear 82 of the delay mechanism 85 rotate integrally. This state in which the first contact surface 81*c* is not in contact with the second contact surface 82*c*, and the first gear 81 and the second gear 82 rotate integrally will be also referred to as the second state. At this time, the time from the start of rotation of the first gear 81 to the start of rotation of the second gear 82 is shorter than the same time in the case where the rotation starts after the first contact surface 81*c* comes into contact with the second contact surface 82*c*, and this time varies depending on the weight of sheets supported on the inner plate 33, that is, the amount of supported sheets.

The active length L of the coil spring 89 in a state in which the first gear 81 and the second gear 82 start rotating integrally when the first contact surface 81*c* is not in contact with the second contact surface 82*c* satisfies a condition $L2<L<L1$. As described above, in the case where the second gear 82 starts rotating together with the first gear 81 before the first contact surface 81*c* comes into contact with the second contact surface 82*c*, the inner plate 33 starts ascending before the pickup roller 6 is positioned at the lower position. Then, the pickup roller 6 comes into contact with the sheet S on the inner plate 33 in a state in which the pickup roller 6 is positioned between the feeding position and the lower position. To be noted, in this state, the inner plate 33 starts ascending before the pickup roller 6 is positioned at the lower position, and the descending pickup roller 6 needs to, at a position lower than the feeding position, come into contact with the upper surface of the sheet S on the inner plate 33. Therefore, the urging force of the coil spring 89 is set such that the inner plate 33 starts ascending at least after the pickup roller 6 has been caused to descend to the feeding position by the second link member 18.

In addition, the urging force applied from the coil spring 89 to the second gear 82 is set to be larger than the load torque derived from the sliding resistance of the gear train of the second gear 82 and the lifter driving gear 28. As a result of this, the delay mechanism 85 securely transitions from the second state to the first state when the cassette 5 is drawn out even in the case where the urging force of the coil spring 89 is set such that the second gear 82 and the first gear 81 start rotating before the first contact surface 81*c* comes into contact with the second contact surface 82*c*. To be noted, the urging force of the coil spring 89 may be set to be larger than the load torque derived from the sliding resistance of the gear train and the weight of the lift-up plate 31 and the inner plate 33 such that the delay mechanism 85 transitions to the second state when the drive of the motor 27 is applied even in the case where the amount of supported sheet S is small.

In the case where the cassette 5 is drawn out from the apparatus body 1A in the state illustrated in FIG. 20B, the load torque applied to the second gear 82 is reduced, and the first contact surface 81*c* is separated from the second contact surface 82*c* again due to the urging force of the coil spring 89 as illustrated in FIG. 20C. As a result of this, drawing out the cassette 5 from the apparatus body 1A causes the first gear 81 and the second gear 82 to be separated from each other by the angle α similarly to FIG. 20A, and the delay mechanism 85 to transition from the second state to the first state.

As described above, by providing the delay mechanism 85, time difference is caused between the rotational drive of the first gear 81 and the second gear 82, and the lift-up plate 31 starts driving after the second link member 18 starts moving. As a result of this, the pickup roller 6 can be brought into contact with the sheet S on the inner plate 33 in a state in which the pickup roller 6 is positioned at the lower position or between the feeding position and the lower position. Therefore, the pickup roller 6 ascending together with the inner plate 33 and the sheet S can be securely detected at the feeding position, and a jam and conveyance failure can be prevented.

In addition, since the coil spring 89 is provided between the first gear 81 and the second gear 82, the time difference between the starts of rotations of the first gear 81 and the second gear 82 is adjusted in accordance with the weight of the sheets S supported on the inner plate 33, that is, the amount of supported sheets. That is, in the state in which the inner plate 33 is fully loaded with sheets S, the time between the start of descent of the pickup roller 6 and the start of ascent of the inner plate 33 is long compared with the case where the amount of supported sheets S on the inner plate 33 is small. However, since the inner plate 33 is fully loaded with sheets S, the upper surface of the sheet S supported on the inner plate 33 is already high, and thus the distance of ascent of the inner plate 33 until the pickup roller 6 is positioned at the feeding position is short compared with the case where the amount of supported sheets S is small.

On the other hand, in the case where the amount of supported sheets S on the inner plate 33 is small, the time between the start of descent of the pickup roller 6 and the start of ascent of the inner plate 33 is short compared with the case where the amount of supported sheets S is large. At this time, the second gear 82 starts rotating together with the first gear 81 before the first gear 81 finishes rotating by the angle α. Since the upper surface of the sheet S supported on the inner plate 33 is low compared with the case of full loading, the distance by which the inner plate 33 ascends until the pickup roller 6 is positioned at the feeding position is long.

As described above, the start timing of driving of the inner plate 33 varies in accordance with the weight of sheets S supported on the inner plate 33, the time from the start of driving of the motor 27 until the moving portion 55 is positioned at the feeding position is substantially leveled. Thus, the pickup roller 6 can be brought into contact with the sheet S on the inner plate 33 in a state in which the moving portion 55 is positioned between the feeding position and the lower position regardless of the weight of sheets S supported on the inner plate 33, that is, the amount of supported sheets.

In addition, the ascending and descending operations of the moving portion 55 and the lift-up plate 31 can be realized by the single motor 27, and thus the number of actuators to be used can be reduced and the costs can be reduced. In addition, the lever member 19 and the second link member 18 enable positioning the pickup roller 6 at such a position as not to interfere with the sheet S when inserting the cassette 5 in the apparatus body 1A, and thus a jam can be prevented. In addition, since the motor 27 does not rotate in the reverse direction, no additional electrical circuit or the like needs to be provided.

To be noted, the delay mechanism 85 of the present exemplary embodiment may be applied to the second exemplary embodiment. In addition, although the delay mechanism 85 is constituted by the first gear 81, the second gear 82, and the coil spring 89, the configuration is not limited to this. For example, the lift-up plate 31 may be configured to start driving after the start of movement of the second link member 18 by using a partially toothed gear of or the like.

In addition, although the delay mechanism 85 is configured to recover from the second state to the first state by using the coil spring 89 in the present exemplary embodiment, the configuration is not limited to this. For example, a magnet, an elastic member such as rubber, or the like may be used instead of the coil spring 89. In addition, the coil spring 89 may be omitted and the motor 27 may be configured to rotate in the reverse direction when the cassette 5 is drawn out from the apparatus body 1A.

In addition, although the first gear 81 and the second gear 82 are configured to rotate integrally as a result of the first contact surface 81*c* of the first gear 81 coming into contact with the second contact surface 82*c* of the second gear 82 in the state in which the inner plate 33 is fully loaded with sheets S, the configuration is not limited to this. For example, the second gear 82 may be pressed by the coil spring 89 and rotate similarly to the case where only few sheets S are supported on the inner plate 33. Conversely, a configuration in which the first gear 81 and the second gear 82 rotate integrally as a result of the first contact surface 81*c* coming into contact with the second contact surface 82*c* also in the case where only few sheets S are supported on the inner plate 33 may be employed.

To be noted, although the motor 27 is used as a drive source in all of the exemplary embodiments described above, the drive source is not limited to a motor, and a solenoid or another actuator may be used as the drive source.

In addition, although the printer 1 of an electrophotographic system has been described in all of the exemplary embodiments described above, the image forming apparatus of the present invention is not limited to this example. For example, the present invention may be applied to an image forming apparatus of an inkjet system that forms an image on a sheet by ejecting a liquid ink through a nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-020783, filed Feb. 7, 2017, and Japanese Patent Application No. 2017-020784, filed Feb. 7, 2017, which are hereby incorporated by reference wherein in their entirety.

What is claimed is:

1. A sheet feeding apparatus comprising:

a sheet support portion configured to support a sheet;

an ascending portion configured to cause the sheet support portion to ascend;

a feeding portion configured to feed the sheet supported by the sheet support portion;

a moving portion configured to support the feeding portion such that the feeding portion is movable between a separated position and a feeding position below the separated position, the separated position being a position at which the feeding portion is separated from the sheet supported by the sheet support portion, the feeding position being a position at which the feeding portion is capable of feeding the sheet;

a holding portion configured to move between a holding position and an allowing position, the holding position being a position at which the holding portion holds the moving portion in a state in which the feeding portion is positioned at the separated position, the allowing position being a position at which the holding portion allows the feeding portion to move to the feeding position;

a drive source configured to generate driving force; and a transmission unit comprising a first transmission portion and a second transmission portion, the first transmission portion being configured to transmit the driving force from the drive source to the ascending portion, the second transmission portion being configured to transmit the driving force from the drive source to the holding portion, wherein the holding portion moves toward the allowing position in a case where the driving force from the drive source is transmitted to the ascending portion and the holding portion respectively through the first transmission portion and the second transmission portion, and the sheet support portion is caused to ascend by the ascending portion, wherein the second transmission portion branches from the first transmission portion, wherein the transmission unit comprises a regulation portion configured to regulate movement of the holding portion from the holding position to the allowing position in a case where the drive source is stopped, and wherein the regulation portion comprises a worm and a worm wheel which engages the worm.

2. The sheet feeding apparatus according to claim 1, wherein the holding portion comprises a rack portion to which driving force is transmitted from the second transmission portion.

3. An image forming apparatus comprising:

the sheet feeding apparatus according to claim 1; and an image forming portion configured to form an image on the sheet fed by the sheet feeding apparatus.

4. A sheet feeding apparatus comprising:

a sheet support portion configured to support a sheet;

an ascending portion configured to cause the sheet support portion to ascend;

a feeding portion configured to feed the sheet supported by the sheet support portion;

a moving portion configured to support the feeding portion such that the feeding portion is movable between a separated position and a feeding position below the separated position, the separated position being a position at which the feeding portion is separated from the sheet supported by the sheet support portion, the feeding position being a position at which the feeding portion is capable of feeding the sheet;

a holding portion configured to move between a holding position and an allowing position, the holding position being a position at which the holding portion holds the moving portion in a state in which the feeding portion is positioned at the separated position, the allowing position being a position at which the holding portion allows the feeding portion to move to the feeding position;

a drive source configured to generate driving force;

a pressing portion configured to press the moving portion and the holding portion;

an urging portion configured to urge the pressing portion such that the feeding portion supported by the moving portion moves to the separated position and the holding portion moves to the holding position; and a transmission unit comprising a first transmission portion and a second transmission portion, the first transmission portion being configured to transmit the driving force from the drive source to the ascending portion, the second transmission portion being configured to transmit the driving force from the drive source to the holding portion, wherein the second transmission portion branches from the first transmission portion, wherein the transmission unit comprises a regulation portion configured to regulate movement of the holding portion from the holding position to the allowing position in a case where the drive source is stopped, the regulation portion being provided at one of the first transmission portion and the second transmission portion, and wherein the second transmission portion comprises a one-way clutch configured to transmit the driving force from the drive source to the holding portion in a case where the holding portion moves from the holding position to the allowing position due to the driving force from the drive source, and a block driving force from the holding portion to the drive source in a case where the holding portion moves from the allowing position to the holding position by being pressed by the pressing portion.

5. An image forming apparatus comprising:

the sheet feeding apparatus according to claim 4; and an image forming portion configured to form an image on the sheet fed by the sheet feeding apparatus.

6. The sheet feeding apparatus according to claim 4, further comprising:

an apparatus body configured to support the moving portion, the holding portion, the pressing portion, the drive source, and the transmission unit; and a drawer portion configured to support the sheet support portion and the ascending portion, be capable of coming into contact with the pressing portion, and be capable of being attached to and drawn out from the apparatus body, wherein, in a state in which the drawer portion has been drawn out from the apparatus body, the drawer portion is separated from the pressing portion, and the holding portion is caused to be positioned at the holding position and the feeding portion is caused to be positioned at the separated position by the pressing portion urged by the urging portion, and wherein, in a state in which the drawer portion is attached to the apparatus body, the drawer portion comes into contact with the pressing portion against an urging force of the urging portion, and the holding portion is held at the holding position by the regulation portion in a state in which the holding portion is separated from the pressing portion.

7. The sheet feeding apparatus according to claim 6, wherein the holding portion moves to the allowing position due to the drive source driving in a state in which the drawer portion is attached to the apparatus body.

8. The sheet feeding apparatus according to claim 6, wherein the ascending portion comprises a driven gear, wherein the first transmission portion comprises a driving gear provided in the apparatus body and configured to engage with the driven gear, and wherein the driven gear engages with the driving gear in a state in which the drawer portion is attached to the apparatus body, and is separated from the driving gear in a state in which the drawer portion has been drawn out from the apparatus body.

9. The sheet feeding apparatus according to claim 6, further comprising a second urging portion configured to urge the moving portion such that the feeding portion moves downward, wherein the urging portion is a first urging portion, and wherein an urging force of the second urging portion is set to be smaller than the urging force of the first urging portion.

10. A sheet feeding apparatus comprising:

a sheet support portion configured to support a sheet;

an ascending portion configured to cause the sheet support portion to ascend;

a feeding portion configured to feed the sheet supported by the sheet support portion;

a moving portion configured to support the feeding portion such that the feeding portion is movable between a separated position and a feeding position below the separated position, the separated position being a position at which the feeding portion is separated from the sheet supported by the sheet support portion, the feeding position being a position at which the feeding portion is capable of feeding the sheet;

a holding portion configured to move between a holding position and an allowing position, the holding position being a position at which the holding portion holds the moving portion in a state in which the feeding portion is positioned at the separated position, the allowing position being a position at which the holding portion allows the feeding portion to move to the feeding position;

a drive source configured to generate driving force;

a transmission unit comprising a first transmission portion and a second transmission portion, the first transmission portion being configured to transmit the driving force from the drive source to the ascending portion, the second transmission portion being configured to transmit the driving force from the drive source to the holding portion;

an apparatus body configured to support the moving portion, the holding portion, the drive source, and the transmission unit;

a drawer portion configured to support the sheet support portion and the ascending portion, and be capable of being attached to and drawn out from the apparatus body;

a detection portion configured to detect that the drawer portion has been attached to the apparatus body and that the drawer portion has been drawn out from the apparatus body; and a controller configured to, in a case where the detection portion has detected that the drawer portion has been attached to the apparatus body, drive the drive source in a first direction, and, in a case where the detection portion has detected that the drawer portion has been drawn out from the apparatus body, drive the drive source in a second direction opposite to the first direction, wherein the second transmission portion branches from the first transmission portion, wherein the transmission unit comprises a regulation portion configured to regulate movement of the holding portion from the holding position to the allowing position in a case where the drive source is stopped, the regulation portion being provided at one of the first transmission portion and the second transmission portion, wherein, in a case where the drive source is driven in the first direction, the sheet support portion is caused to ascend by the ascending portion and the holding portion moves toward the allowing position, and wherein, in a case where the drive source is driven in the second direction, the holding portion moves toward the holding position.

11. The sheet feeding apparatus according to claim 10, wherein the first transmission portion comprises a one-way clutch configured to transmit driving force from the drive source in the first direction to the ascending portion and not to transmit driving force from the drive source in the second direction to the ascending portion.

12. The sheet feeding apparatus according to claim 10, further comprising:

a first movement regulation portion configured to regulate movement of the holding portion positioned at the holding position in a first movement direction by coming into contact with the holding portion, the first movement direction being opposite to a direction in which the holding portion moves from the holding position toward the allowing position; and a second movement regulation portion configured to regulate movement of the holding portion positioned at the allowing position in a second movement direction by coming into contact with the holding portion, the second movement direction being opposite to a direction in which the holding portion moves from the allowing position toward the holding position, wherein the second transmission portion comprises a torque limiter configured not to transmit, to the holding portion, driving force that moves the holding portion in the first movement direction in a state in which the holding portion is in contact with the first movement regulation portion, and not to transmit, to the holding portion, driving force that moves the holding portion in the second movement direction in a state in which the holding portion is in contact with the second movement regulation portion.

13. An image forming apparatus comprising:

the sheet feeding apparatus according to claim 10; and an image forming portion configured to form an image on the sheet fed by the sheet feeding apparatus.

14. A sheet feeding apparatus comprising:

a sheet support portion configured to support a sheet;

an ascending portion configured to cause the sheet support portion to ascend;

a feeding portion configured to feed the sheet supported by the sheet support portion;

a moving portion configured to support the feeding portion such that the feeding portion is movable between a separated position and a feeding position below the separated position, the separated position being a position at which the feeding portion is separated from the sheet supported by the sheet support portion, the feeding position being a position at which the feeding portion is capable of feeding the sheet;

a holding portion configured to move between a holding position and an allowing position, the holding position being a position at which the holding portion holds the moving portion in a state in which the feeding portion is positioned at the separated position, the allowing position being a position at which the holding portion allows the feeding portion to move to the feeding position;

a drive source configured to generate driving force;

a transmission unit comprising a first transmission portion and a second transmission portion, the first transmission portion being configured to transmit the driving force from the drive source to the ascending portion, the second transmission portion being configured to transmit the driving force from the drive source to the holding portion; and a feeding detection portion configured to detect the feeding portion positioned at the feeding position, wherein the second transmission portion branches from the first transmission portion, wherein the transmission unit comprises a regulation portion configured to regulate movement of the holding portion from the holding position to the allowing position in a case where the drive source is stopped, the regulation portion being provided at one of the first transmission portion and the second transmission portion, wherein the moving portion supports the feeding portion such that the feeding portion is movable between the separated position, the feeding position, and a lower position below the feeding position, wherein the holding portion is configured to, at the allowing position, hold the moving portion in a state in which the feeding portion is positioned at the lower position, and wherein the transmission unit comprises a delay mechanism configured to start driving the ascending portion after start of movement of the holding portion.

15. The sheet feeding apparatus according to claim 14, wherein the delay mechanism comprises a first gear and a second gear, and is configured to take a first state and a second state, the first gear being disposed in a drive transmission path between the drive source and the holding portion, the second gear being disposed in a drive transmission path between the drive source and the ascending portion coaxially with the first gear, the first state being a state in which the first gear rotates and the second gear does not rotate, the second state being a state in which the first gear and the second gear rotate integrally.

16. The sheet feeding apparatus according to claim 15, wherein the delay mechanism comprises a gear urging member disposed between the first gear and the second gear and configured to urge the first gear and the second gear such that the delay mechanism takes the first state.

17. The sheet feeding apparatus according to claim 16, wherein the delay mechanism takes the second state in a case where an urging force applied from the gear urging member to the second gear surpasses load torque applied to the second gear.

18. The sheet feeding apparatus according to claim 17, wherein the load torque takes a value corresponding to a weight of the sheet supported by the sheet support portion.

19. The sheet feeding apparatus according to claim 16, further comprising:

an apparatus body configured to support the moving portion, the feeding detection portion, the holding portion, the drive source, and the transmission unit; and a drawer portion configured to support the sheet support portion and the ascending portion, and be capable of being attached to and drawn out from the apparatus body, wherein the delay mechanism is caused to transition from the second state to the first state by the gear urging member in a case where the apparatus body is drawn out from the apparatus body.

20. The sheet feeding apparatus according to claim 15, wherein the second gear is supported to be relatively movable with respect to the first gear, and wherein at least one of the first gear and the second gear comprises a regulation rib configured to regulate an attachment phase of the second gear to the first gear.

21. The sheet feeding apparatus according to claim 15, wherein the first gear comprises a first contact surface, wherein the second gear comprises a second contact surface provided to be capable of coming into contact with and being separated from the first contact surface, and wherein the delay mechanism is caused to take the second state by the first contact surface coming into contact with the second contact surface.

22. An image forming apparatus comprising:

the sheet feeding apparatus according to claim 14; and an image forming portion configured to form an image on the sheet fed by the sheet feeding apparatus.

23. A sheet feeding apparatus comprising:

a sheet support portion configured to support a sheet;

an ascending portion configured to cause the sheet support portion to ascend;

a feeding portion configured to feed the sheet supported by the sheet support portion;

a moving portion configured to support the feeding portion such that the feeding portion is movable between a separated position, a feeding position below the separated position, and a lower position below the feeding position, the separated position being a position at which the feeding portion is separated from the sheet supported by the sheet support portion, the feeding position being a position at which the feeding portion is capable of feeding the sheet supported by the sheet support portion;

a detection portion configured to detect the feeding portion positioned at the feeding position;

a holding portion configured to move between a holding position and an allowing position, the holding position being a position at which the holding portion holds the moving portion in a state in which the feeding portion is positioned at the separated position, the allowing position being a position at which the holding portion is capable of holding the moving portion in a state in which the feeding portion is positioned at the lower position and allows the feeding portion to move from the lower position to the feeding position;

a drive source configured to generate driving force;

a transmission unit configured to transmit the driving force from the drive source to the ascending portion and the holding portion; and a delay mechanism configured to start driving the ascending portion after start of movement of the holding portion such that, in a case where the drive source is driven, the feeding portion comes into contact with an upper surface of the sheet supported by the sheet support portion in a state in which the feeding portion is positioned between the feeding position and the lower position.

24. An image forming apparatus comprising:

the sheet feeding apparatus according to claim 23; and an image forming portion configured to form an image on the sheet fed by the sheet feeding apparatus.

* * * * *